US009010870B2

(12) United States Patent
Myers et al.

(10) Patent No.: US 9,010,870 B2
(45) Date of Patent: Apr. 21, 2015

(54) MINING SYSTEMS

(71) Applicant: Seneca Industries Inc., Beckley, WV (US)

(72) Inventors: Timothy J. Myers, Hurley, WI (US); Michael Cline, Carlinville, IL (US); John Dickinson, Palm Beach Gardens, FL (US)

(73) Assignee: Seneca Industries Inc., Beckley, WV (US)

( * ) Notice: Subject to any disclaimer, the term of this patent is extended or adjusted under 35 U.S.C. 154(b) by 0 days.

(21) Appl. No.: 14/267,149

(22) Filed: May 1, 2014

(65) Prior Publication Data

US 2014/0265524 A1 Sep. 18, 2014

Related U.S. Application Data

(63) Continuation of application No. 13/958,330, filed on Aug. 2, 2013, now Pat. No. 8,770,667, which is a continuation of application No. 13/826,463, filed on Mar. 14, 2013.

(51) Int. Cl.

| | |
|---|---|
| ***E21D 23/00*** | (2006.01) |
| ***E21D 23/12*** | (2006.01) |
| ***E21C 41/16*** | (2006.01) |
| ***E21D 11/40*** | (2006.01) |
| ***E21C 27/00*** | (2006.01) |

(52) U.S. Cl.

CPC ..... *E21D 23/12* (2013.01); *E21C 41/16* (2013.01); *E21D 23/0091* (2013.01); *E21D 11/40* (2013.01); *E21C 27/00* (2013.01)

(58) Field of Classification Search

CPC ..... E21D 23/12; E21D 23/0091; E21D 11/40; E21C 41/16; E21C 27/00

USPC ..... 299/1.1, 1.3, 1.4, 1.7, 1.8, 1.9, 11, 18, 299/19, 30, 33, 64

See application file for complete search history.

(56) References Cited

U.S. PATENT DOCUMENTS

| | | | |
|---|---|---|---|
| 1,276,952 | A | 8/1918 | O'Toole |
| 3,362,750 | A | 1/1968 | Carnegie |
| 3,856,356 | A | 12/1974 | Allen et al. |
| 3,999,804 | A | 12/1976 | Simpson |
| 4,065,929 | A | 1/1978 | Simpson |

(Continued)

FOREIGN PATENT DOCUMENTS

| | | |
|---|---|---|
| GB | 2232697 | 12/1990 |

OTHER PUBLICATIONS

Notification of Transmittal of the International Search Report and the Written Opinion of the International Searching Authority, or the Declaration, issued in International Application No. PCT/US2014/026161, mailed Aug. 12, 2014, 17 pages.

*Primary Examiner* — John Kreck
*Assistant Examiner* — Carib Oquendo
(74) *Attorney, Agent, or Firm* — Fish & Richardson P.C.

(57) ABSTRACT

Methods and equipment have been developed that combine the use of continuous miners, flexible conveyor trains, and longwall mining techniques to provide flexible and efficient removal of resources from subterranean formations. Some systems include: a main gate; and a tailgate connected to the maingate by an active mine face; wherein the active mine face extends at an angle between 95° and 135° relative to the maingate.

33 Claims, 22 Drawing Sheets

(56) References Cited

U.S. PATENT DOCUMENTS

| | | | | | |
|---|---|---|---|---|---|
| 4,082,360 | A | | 4/1978 | Campbell et al. | |
| 4,102,550 | A | | 7/1978 | Campbell et al. | |
| 4,196,934 | A | | 4/1980 | MacRae | |
| 4,268,088 | A | | 5/1981 | Price et al. | |
| 4,309,130 | A | | 1/1982 | Bemmerl | |
| 4,323,002 | A | | 4/1982 | Wake | |
| 4,465,408 | A | | 8/1984 | Krieger et al. | |
| 4,523,512 | A | | 6/1985 | Hessel et al. | |
| 4,526,495 | A | | 7/1985 | Becker et al. | |
| 4,784,257 | A | * | 11/1988 | Doerr | 198/594 |
| 4,798,417 | A | | 1/1989 | Blumenthal et al. | |
| 4,852,724 | A | | 8/1989 | Bodimer | |
| 4,887,935 | A | | 12/1989 | Koppers et al. | |
| 5,029,943 | A | * | 7/1991 | Merriman | 299/1.7 |
| 5,039,257 | A | | 8/1991 | Bithell | |
| 5,156,256 | A | | 10/1992 | David | |
| 5,163,738 | A | | 11/1992 | Linsingen-Heintzmann | |
| 5,238,330 | A | | 8/1993 | Plevak et al. | |
| 5,265,941 | A | | 11/1993 | Marteney | |
| 5,474,365 | A | | 12/1995 | von Linsingen-Heintzmann | |
| 5,613,418 | A | | 3/1997 | Guido | |
| 5,769,504 | A | | 6/1998 | Maity et al. | |
| 5,967,616 | A | | 10/1999 | Offutt et al. | |
| 6,237,753 | B1 | | 5/2001 | Walter et al. | |
| 6,481,802 | B1 | | 11/2002 | Kussel | |
| 6,530,537 | B2 | | 3/2003 | Hanlon | |
| 6,796,616 | B2 | | 9/2004 | Harman et al. | |
| 6,913,321 | B2 | | 7/2005 | Harman et al. | |
| 7,540,693 | B2 | | 6/2009 | Gross et al. | |
| 7,815,043 | B2 | | 10/2010 | Hawkins et al. | |
| 8,297,888 | B2 | | 10/2012 | Voss | |
| 8,376,467 | B2 | | 2/2013 | Junker et al. | |
| 8,474,918 | B2 | | 7/2013 | Hackelboerger et al. | |
| 8,567,870 | B2 | | 10/2013 | Junker et al. | |
| 8,567,871 | B2 | | 10/2013 | Junker et al. | |
| 8,590,982 | B2 | | 11/2013 | Holme | |
| 8,608,248 | B2 | | 12/2013 | Junker et al. | |
| 2003/0075970 | A1 | | 4/2003 | Hainsworth et al. | |
| 2011/0184597 | A1 | * | 7/2011 | Thomas et al. | 701/22 |

* cited by examiner

MINING SYSTEMS

RELATED APPLICATIONS

This application is a continuation of U.S. application Ser. No. 13/958,330, filed Aug. 2, 2013; which is a continuation of U.S. application Ser. No. 13/826,463, filed Mar. 14, 2013. The entire contents of the prior applications are incorporated by reference herein.

TECHNICAL FIELD

This invention relates to mining methods and equipment.

BACKGROUND

Longwall mining is a method of mining in which a relatively long mining face (typically in the range 200 to 460 m) that is created by driving a roadway at right angles between two continuous miner sections that form the sides of the longwall block, with one rib of this new roadway forming the longwall face. Once the longwall face equipment has been installed, coal can be extracted along the full length of the face in slices of a given width using a shearer depositing coal on an armored face conveyor. The modern longwall face is supported by hydraulically powered roof supports and these supports are progressively advanced to support the newly extracted face as slices are taken, allowing the section where the coal had previously been excavated and supported to collapse. This process is repeated continuously, thus completely removing a rectangular block of coal.

Shortwall mining is a method of mining in which a continuous miner cuts and loads from a shorter mining face (typically in the range of 30 to 200 m) that is created by driving a roadway between two continuous miner sections that for the sides of the block, with one rib of this new roadway forming the shortwall face. Once the shortwall face equipment has been installed, coal can be extracted along the full length of the face in slices determined by the cutting width of the continuous miner. The excavated material is loaded by the continuous miner to haulage systems. Ventilation and haulage is provided from the headgate entries.

SUMMARY

Methods and equipment have been developed that combine the use of continuous miners, flexible conveyor trains, and longwall mining techniques to provide flexible and efficient removal of resources from subterranean formations. These methods and equipment can be applied to smaller reserves than the reserves typically considered appropriate for longwall mining and can provide flexibility in avoiding, for example, recovering from edges with irregular boundaries caused by property control, geologic obstacles or geographic obstacles. These methods and equipment also can provide increased efficiency relative to room and pillar or shortwall mining techniques.

In one aspect, methods for use in a mining operation include: advancing a continuous miner towards an angled face that extends from a headgate to a tailgate; performing an angled cutting turn in which the continuous miner turns less than 90°; advancing the continuous miner along the angled face to the tailgate in a cutting operation; depositing material extracted from the face by the continuous miner on a flexible conveyor train; supporting a roof of the mine along the angled face with a plurality of powered roof supports; withdrawing the flexible conveyor train along the angled face; withdrawing the continuous miner along the angled face; and sequentially advancing each of the plurality of powered roof supports towards the angled face.

Embodiments can include one or more of the following features. The steps can be repeated with a new face generated by each repetition of steps substantially parallel to the angled face generated by previous iterations of the steps. The flexible conveyor train is a first flexible conveyor train and the method comprises discharging extracted material from the first flexible conveyor train to a second flexible conveyor train. Sequentially advancing each of the plurality of powered roof supports towards the angled face includes sequentially advancing each of the plurality of powered roof supports at least 10 feet towards the angled face. Some continuous miners are wider and are accommodated by advancing each of the plurality of powered roof supports at least 11.5 feet towards the angled face. Sequentially advancing each of the plurality of powered roof supports towards the angled face includes sequentially advancing each of the plurality of powered roof supports in coordination with movement of the continuous miner. Sequentially advancing each of the plurality of powered roof supports towards the angled face includes pushing loose material into the path of the continuous miner by extending dozer blade spill plates on the powered roof supports. The angled face is an angled coal face.

In one aspect, a system for use in a mining operation includes: a continuous miner configured to cut material from a face; a plurality of powered roof supports positioned along the face; and a guidance system operable to receive a location signal based on relative location of the continuous miner along the face and to send control signal to the plurality of powered roof supports positioned along the face.

Embodiments can include one or more of the following features. The system includes a cable reel assembly operable to store, feed, and receive a cable attached to the continuous miner. The cable reel assembly is mounted on one of the plurality of powered roof supports. Portions of the cable reel are movable between a plurality of positions along an axis of symmetry of the powered roof support on which the cable reel is mounted. The cable reel assembly comprises a rotating mount enabling rotation of a cable reel about a first axis to feed or receive the cable and rotation of the cable reel about a second axis to track the movement of the continuous miner relative to the cable reel assembly. The system includes a flexible conveyor train positioned to receive material from the continuous miner as the continuous miner makes advances along a face extending from a headgate to a tailgate. The flexible conveyor train is a first flexible conveyor train and the system comprises a second flexible conveyor train, the second flexible conveyor train positioned to receive material from the first flexible conveyor train. Each of the plurality of powered roof supports is movable between a retracted position and an extended position supporting at least 11 linear feet of roof than the retracted position.

In one aspect, systems for extracting material from subterranean formation include: a main gate; a tailgate connected to the maingate by an active mine face, the active mine face extending at an angle between 95° and 135° relative to the maingate.

Embodiments can include one or more of the following features. The angle is between is less than 130° (e.g., less than 125°, 120°, 115°, or 110°). The angle is greater than 95° (e.g., greater than 100° or 105°). The active mine face extends between 100 feet and 700 feet from the maingate to the tailgate. The active mine face extends more than 200 feet from the maingate to the tailgate.

In one aspect, a powered roof support includes: a canopy configured to directly contacts a roof of a mine; a base configured to rest on a floor of the mine, the base comprising a spill plate and a push cylinder with a maximum stroke greater than 11 feet; and a pair of hydraulic legs 84 attaching the canopy to the base.

Embodiments can include one or more of the following features. The push cylinder is a multiple-stage push cylinder with nested hydraulic chambers. The push cylinder is a double-stage push cylinder. The push cylinder is a triple-stage push cylinder. The nested hydraulic chambers that can extend up to four times a refracted length of the push cylinder. The base has a length between 12 feet and 18 feet and a width between 4 feet and 6 feet. The canopy has a length between 20 feet and 26 feet and a width between 4 feet and 10 feet.

The described mine layouts and systems can provide several advantages. It can be used to recover smaller reserves than feasible in traditional longwall mining, while requiring less capital than longwall mining and providing more efficiency than room and pillar mining. It can provide flexibility in terms of avoiding geologic or geographic obstacles or recovering materials from seams having edges with irregular boundaries. In comparison to previous shortwall mining techniques in which the mining face is perpendicular to the main gate, there is less unsupported exposed roof at the turn corner between the headgate and the face, resulting in less danger of roof collapse and improved safety.

The details of one or more embodiments of the disclosure are set forth in the accompanying drawings and the description below. Other aspects, features, and advantages of the disclosure will be apparent from the description and drawings, and from the claims.

DETAILED DESCRIPTION

Methods and equipment have been developed that combine the use of continuous miners, flexible conveyor trains, and longwall mining techniques to provide flexible and efficient removal of resources from subterranean formations. These methods and equipment can be applied to smaller reserves than the reserves typically considered appropriate for longwall mining and can provide flexibility in avoiding, for example, geologic or geographic obstacles or recovering from edges with irregular boundaries. These methods and equipment also can provide increased efficiency relative to room and pillar mining techniques.

We discuss examples of these methods and equipment in the context of extracting coal from a coal bed but they can be applied to other mining applications including, for example, mining trona, gypsum, potash and salt.

Figure 1:
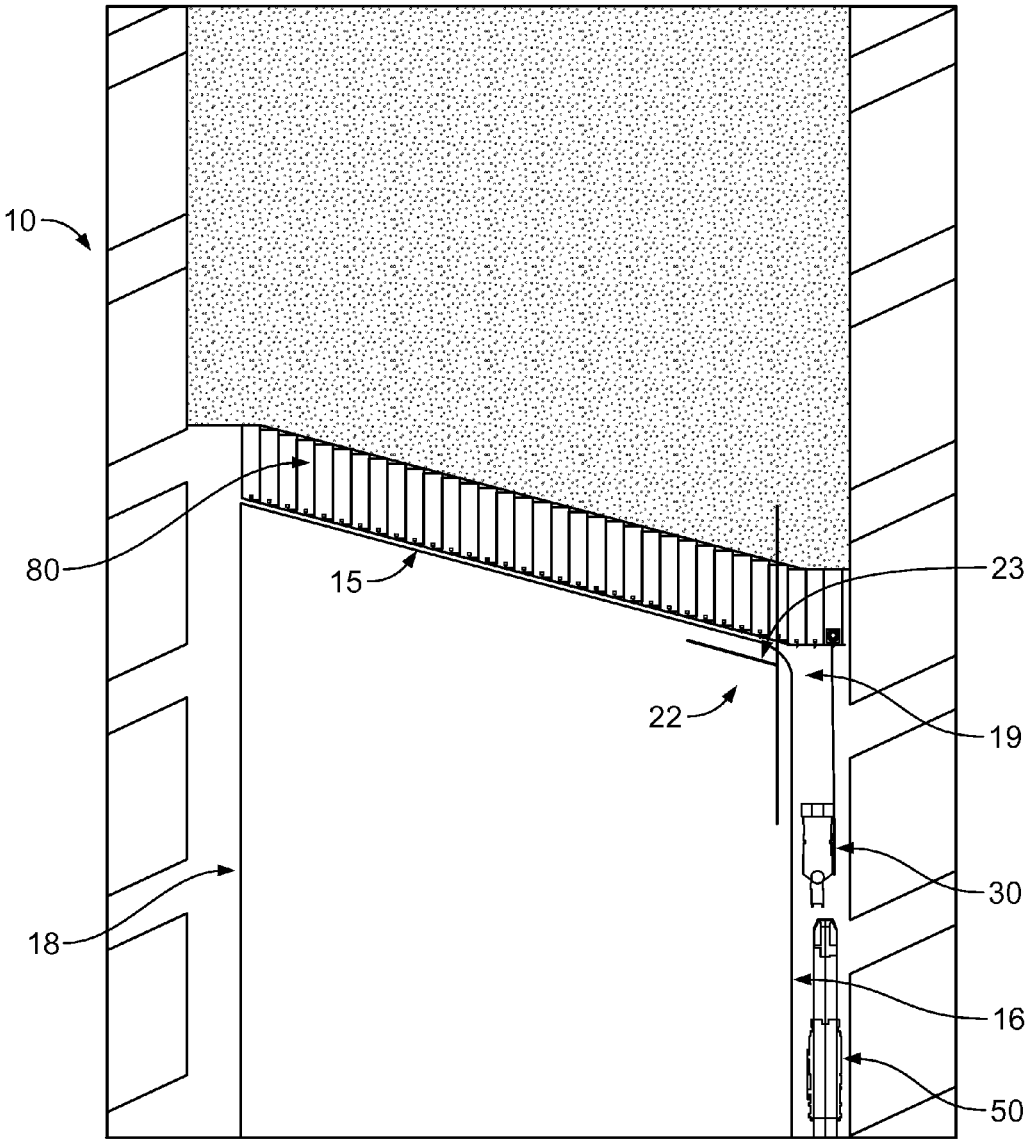
FIG. 1 is a schematic of an angled mine layout.

FIG. 1 illustrates an angled mine layout 10 for use, for example, in extracting coal from a coal bed. Coal is extracted from an active face 15, also known as the mine face or seam. The location of the face 15 changes during mining operations as coal is removed from the face 15. The face 15 is accessed by at least two sets of tunneled roads, called entries, gates, or gateroads 16, 18. Personnel, supplies, ventilating air, and the mined coal extracted at the coal face 15 can pass through these roads to access the surface above. The headgate 16 is the primary gateroad used to access the face 15 and experiences the most travel during operations. The point at which the face 15 and the headgate 16 intersect, called the turn corner 19, can be considered the "beginning" of the face 15. The gateroad that intersects the face 15 at its opposite end is the tailgate 18.

Coal is extracted from the face 15 using a continuous miner 30. A flexible conveyor train 50 follows the continuous miner 30 as the continuous miner 30 performs mining operations and creates a path along the coal face 15. The flexible conveyor train 50 receives the coal extracted from the coal face 15 by the continuous miner 30 and transports the coal, for example, to a fixed section belt for removal from the mine 10.

Multiple powered roof supports 80 are positioned along the length of the face 15. Removal of material from the face 15 by the continuous miner 30 causes a loss in structural integrity of the mine roof, and powered roof supports 80 provide support to the newly created roof. As the continuous miner 30 removes coal along the face 15, the powered roof supports 80 automatically advance from their previous position to a new position that holds up the new section of mine roof just created by the passing of the continuous miner 30.

The face 15 intersects the headgate 16 at an angle 22 (e.g., the angle extending from the face 15 through the un-mined formation to the wall of the maingate) at turn corner 19. The angle 22 is an obtuse angle, i.e., greater than 90 degrees. As the face 15 is oblique to the headgate 16 rather than perpendicular to it, equipment that approaches the coal face 15 along the headgate 16 turns through an angle 23 of less than 90 degrees in order to travel along the coal face 15. In the illustrated layout, the angle 22 is approximately 105 degrees. In some embodiments, the configuration of the roof supports 80 limits the angle 22 between the headgate 16 and the face 15 to less than 135 degrees (e.g., less than 130°, 125°, 120°, 115°, 110°, etc.). In some embodiments, the turning radius of the equipment being used limits the angle 22 between the headgate 16 and the face 15 to greater than 90° (e.g., greater than 95°, 100°, 105°, etc.).

Powered roof supports traditionally attached to face conveyor perpendicularly. Greater angles between the headgate 16 and the face 15 increase the length of the face 15 and can increase the number of expensive powered roof supports required along the face 15. Previous wall mining techniques were implemented with the face perpendicular to gates in part to minimize the number of roof supports necessary since the roof support cost, for example, approximately $350,000 USD each. In addition, this geometry works well with the advancing of the system. The distance between gate roads is fixed in a longwall application but the shortwall application allows for some flexibility in the width of the face as the tolerances are not as critical.

A mining layout with a face angled to relative to the main gate can enable implementing shortwall mining techniques with a continuous miner in conjunction with a flexible conveyor train. Surprisingly, the resulting increases in efficiency can counterbalance the additional capital costs associated with additional roof supports required for this configuration.

In addition, diagonal attachment of the powered roof supports to the face conveyor in the mining layout with the face 15 angled relative to the maingate 16 can reduce the area of unsupported roof at the turn corner between the maingate 16 and the face 15.

The angled line layout 10 can be used in combination with the innovative continuous miner 30 and powered roof supports 80 described below in a mining operation that can provide flexible and efficient removal of resources from subterranean formations.

Continuous Miner

Figure 2A:
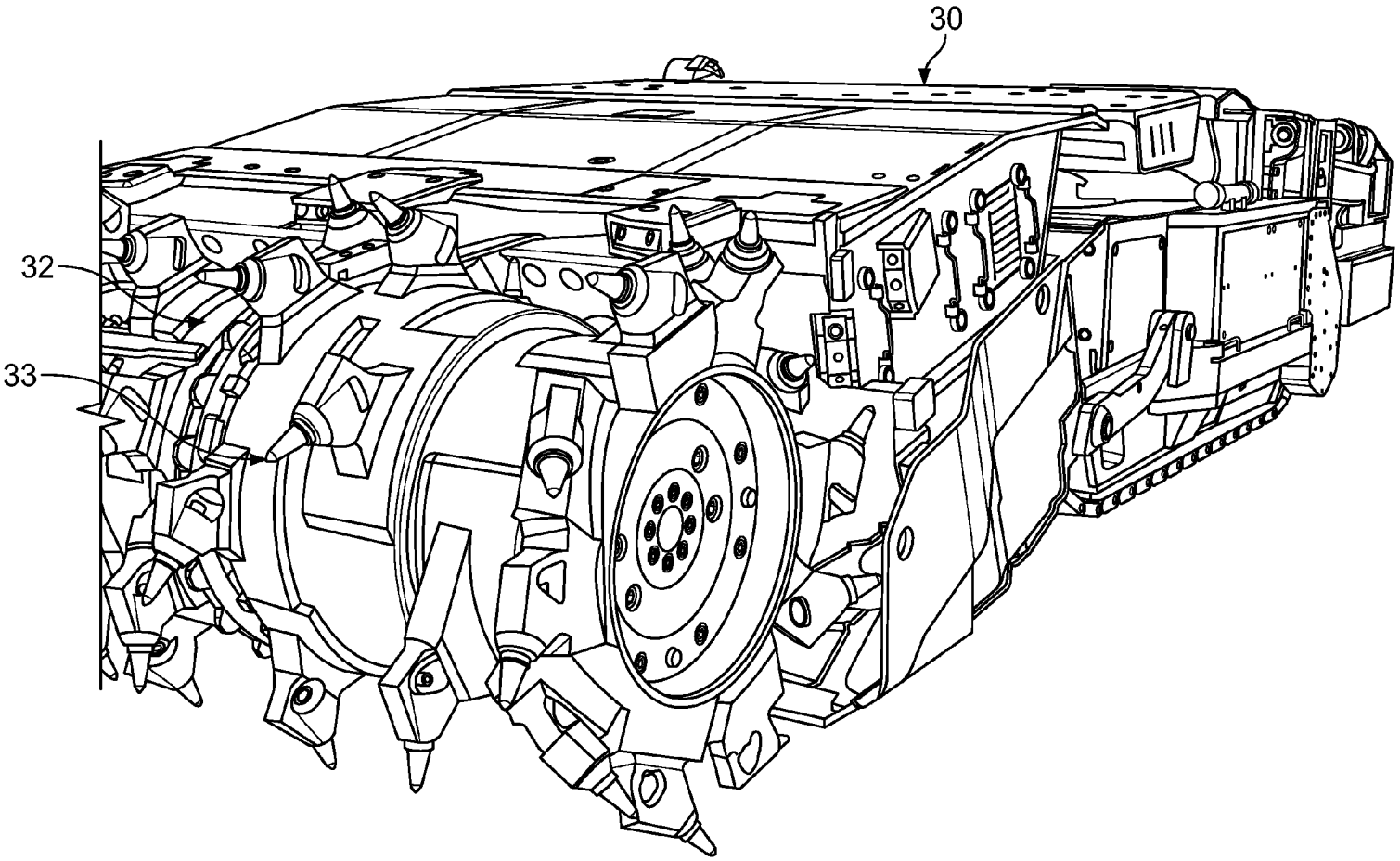
FIGS. 2A and 2B illustrate a continuous miner.
Figure 2B:
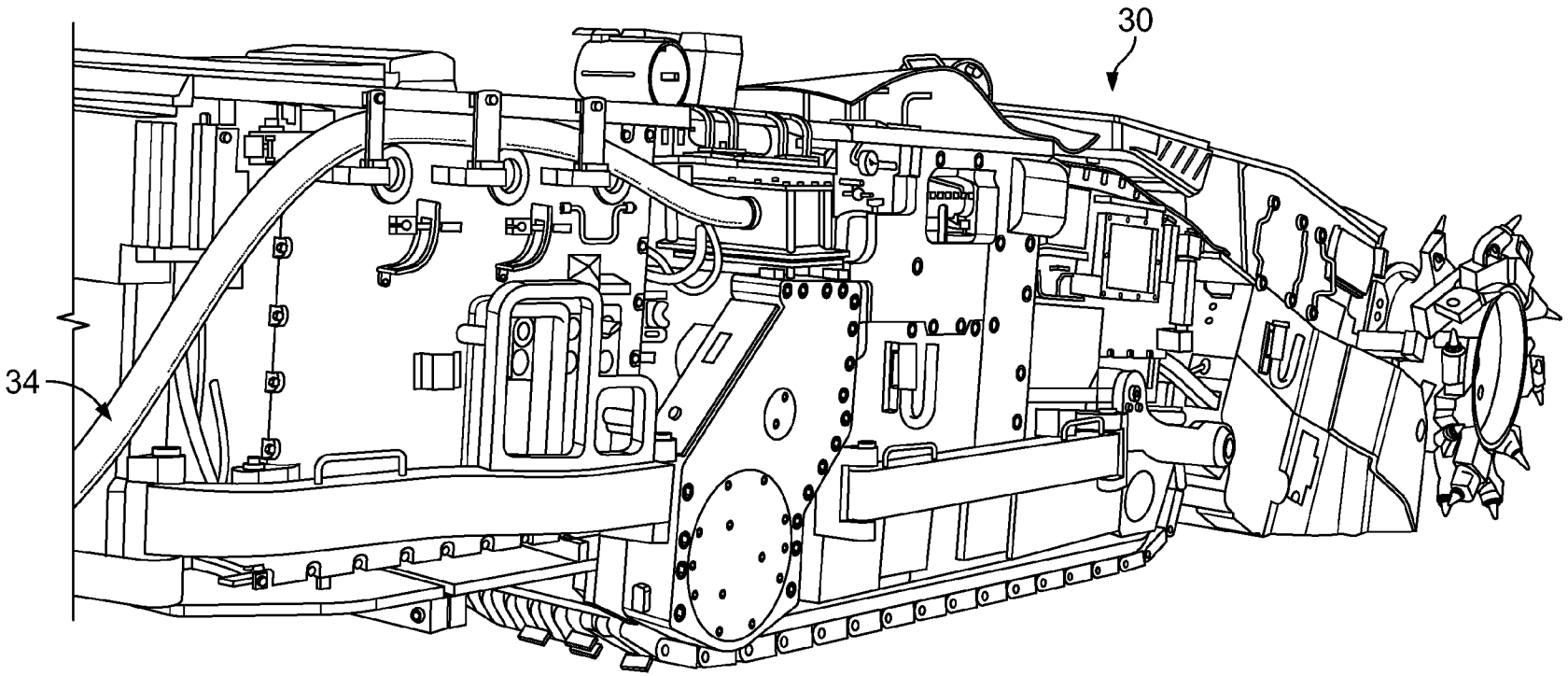

FIGS. 2A and 2B illustrate a continuous miner machine that has a large rotating steel drum 32 equipped with tungsten carbide teeth 33 that scrape coal from the coal face 15. Continuous miners are traditionally used in a "room and pillar" mining system where the mine is divided into a series of 20-to-30 foot "rooms" or work areas cut into the coal bed. A continuous miner can mine as much as 38 short tons of coal a minute, and can remove swaths of material approximately 11.5 feet wide. Continuous miners can utilize, for example, conveyors, ram cars or shuttle cars to transport the removed coal from the coal face, and unlike the shearers often used in longwall mining operations, is independently mobile rather than carried or otherwise conveyed along the length of the coal face 15.

A trailing cable 34 (see FIG. 2B) provides power to the continuous miner 30. The cable is deployed from a separate cable reel (described below) rather than being mounted on the continuous miner. The operator controls the continuous miner by wireless systems. The water is supplied to the continuous miner through a separate water hose.

This approach provides the continuous miner with significantly greater flexibility by controlling the length of the cable along the shortwall face and headgate entry in contrast to existing continuous miners which incorporate a trailing cable 34 which is pulled along the mine floor. In addition, this approach can be safer for the operator of the continuous miner.

Cables 34 are typically approximately 2 inches in diameter and weigh approximately 3 lb. per foot. Traditional continuous miner operations required that a worker physically position the continuous miner cable and water line as the machine was maneuvered. This required the operator to be outside of the spill plate of the flexible conveyor train in a relatively exposed position. Traditional continuous miner operations also require the operator to pick up the continuous miner cable and place loops of the cable on holders on the sides of the continuous miner when the continuous miner was backing up.

By using the cable reel and having the water line carried by the flexible conveyor train (FCT) unit, the operator can now be positioned behind the spill plate and under the powered roof support. This position has fewer hazards to the operator than positioning near the machine. In addition, use of the cable reel eliminates the need for the operator to pick up the continuous miner cable and place loops of the cable on holders on the sides of the continuous miner when the continuous miner is backing up.

Flexible Conveyor Train

Figure 3:
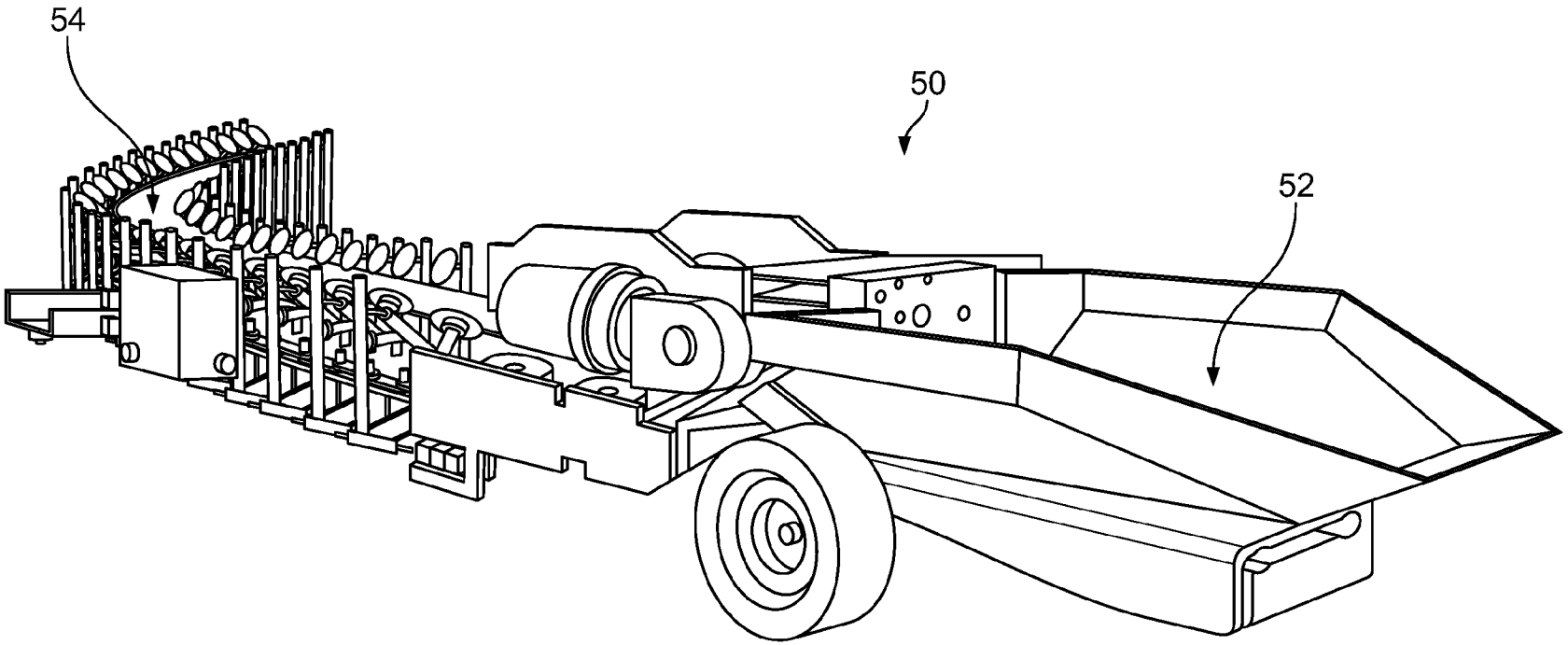
FIG. 3 illustrates a flexible conveyor train.

FIG. 3 illustrates a flexible conveyor train 50. The use of the flexible conveyor train along the face 15 is enabled by the angle of the face relative to the main gate. The material extracted by the continuous miner 30 is loaded into a hopper 52 located at the front end of the flexible conveyor train 50. The flexible conveyor train removes the received material from the face 15 by conveying it via a conveyor belt 54 running along the length of the flexible conveyor train 50. Receiving the coal from the continuous miner 30 and transports the coal, for example, to a fixed section belt for removal from the mine 10, the flexible conveyor train 50 reduces the total number of mobile machines (e.g., shuttle cars) and workers in the mine 10. Higher capacity production is also possible as the continuous haulage eliminates the bottle necks and wait times during batch haulage systems. In addition, material degradation is reduced with the reduction of transfer points improving product quality while reducing dust and improving safety. Flexible conveyor trains are typically provided with radio remote controls similar to the continuous miners.

As flexible conveyor train 50 both follows the continuous miner 30 and removes material from the face 15, varying parts of the conveyor 54 must bend through angle 23 as they reach the turn corner 19. The angled mine layout 10 reduces this angle from the traditionally used 90 degrees. Although relatively flexible, the flexible conveyor train 50 requires a turn radius which can be reduced with the reduction in angle 23.

Powered Roof Supports

Figure 4A:
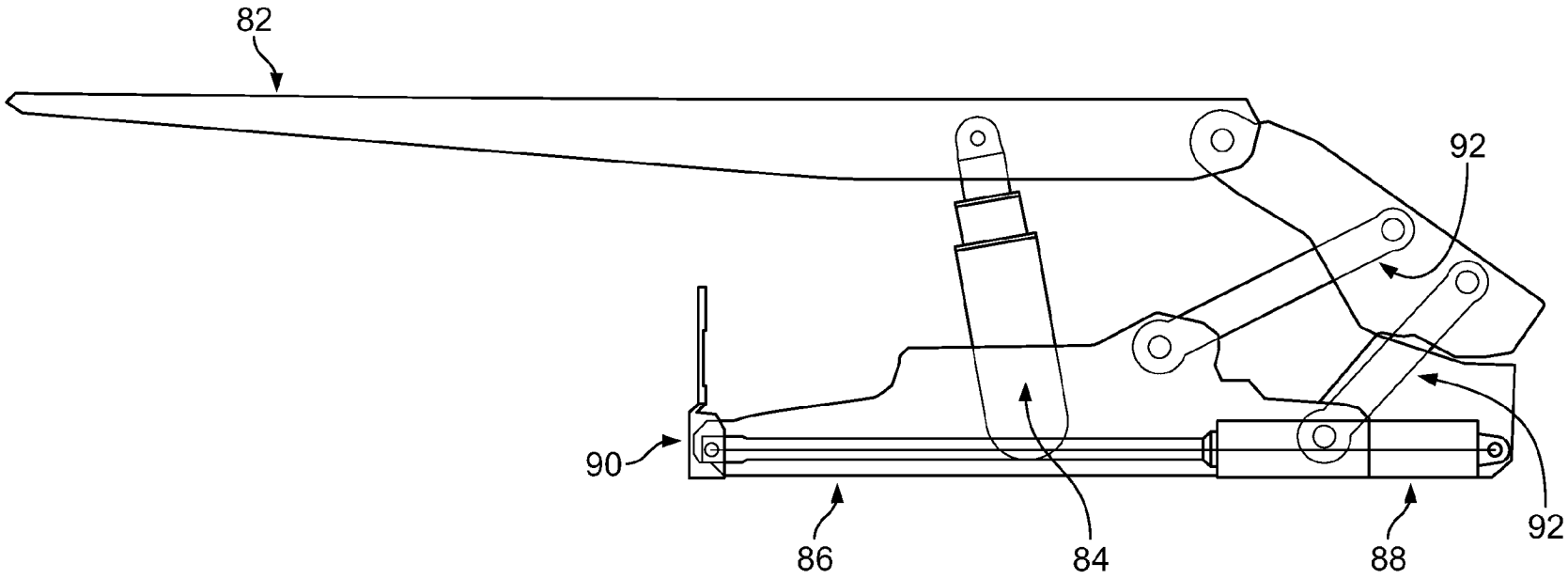
FIGS. 4A and 4B are, respectively, a schematic side and profile views of a powered roof support.
Figure 4B:
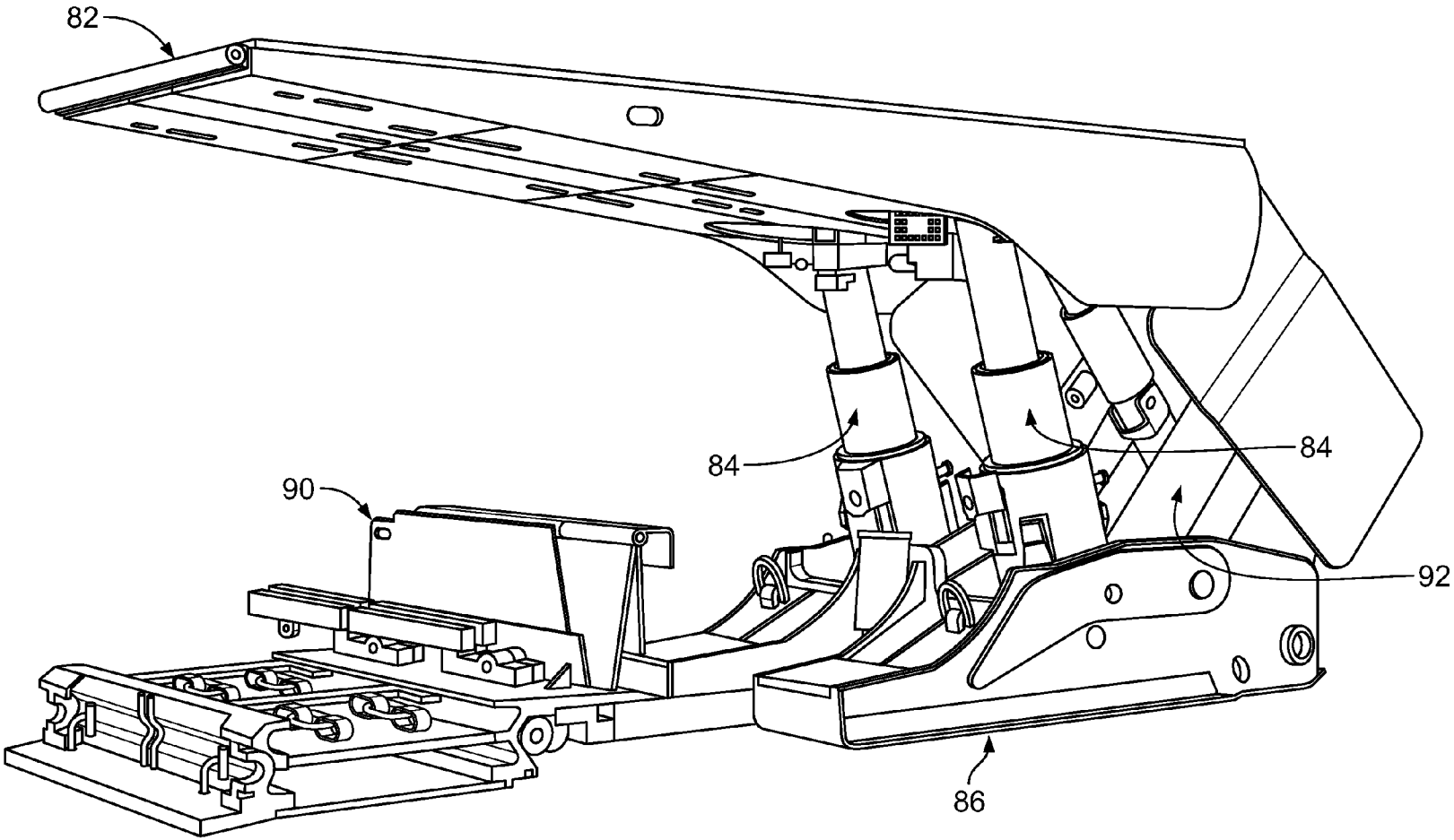

As shown in FIGS. 4A and 4B, the roof supports 80 have a canopy, or shield canopy 82 that directly contacts the mine roof on its upper surface. The number of powered roof supports 80 shown in the figures is not intended to limit the number of roof supports 80 used in an angled mine layout 10. The number of roof supports is chosen based on a number of factors of a particular mine 10, including the length of the face 15 to be worked. For example, 107 to 122 roof supports 80 may be used in a mine layout with a 700 feet face. The roof supports 80 are typically placed adjacent to each other, with a spacing of about 2 meters between centerlines of adjacent units.

A pair of hydraulic legs 84 attach the roof support canopy 82 to a base 86. The hydraulic legs 84 provide the force necessary to push the canopy 82 upwards and buttress the mine roof. The roof support base 86 includes a powered push cylinder, or ram 88. The push cylinder 88 advances the roof support 80, and pushes a spill plate or dozer blade 90 attached to the end of the push cylinder 88. The push cylinder used in the angled mine layout 10 requires a stroke of approximately 144 inches, or 11.5 feet, to traverse the width of unsupported roof left by the passage of the continuous miner 30. Current roof supports in longwall mining are configured to traverse a distance left by a shearer cut, which is typically less than 44 inches, or less than one third of the distance of the cut left by the continuous miner 30. To accommodate this greater distance, push cylinder 88 is a double-stage, or triple-stage push cylinder with nested chambers hydraulic chambers that can extend up to four times the original length of the ram cylinder. A triple stage push cylinder is formed in a series of nested hydraulic rams which un-nest from each other in series. Consequently, the push cylinder 88 has a larger diameter than push cylinders traditionally used for roof supports. To accommodate the larger diameter of the push cylinder 88, the roof support base 86 has dimensions of approximately 14.8 feet long by 5.34 feet wide. The canopy 82 is correspondingly approximately 22.7 feet long and 6.55 feet wide, and is capable of supporting up to 2000 tons of load.

During operation, the spill plate 90 is extended by the push cylinder 88 after the flexible conveyor train and the continuous miner are withdrawn. As the spill plate 90 advances across the mine floor, it pushes any spilled materials left by the recently passed continuous miner 30 and flexible conveyor train 50 across the mine floor. This places the spilled materials into the vicinity of the newly mined face 15, ready to be removed by the continuous miner 30 and flexible conveyor train 50 on their next pass along the face. When the spill plate 90 is fully extended, the powered roof supports sequentially move forward by lowering the hydraulic legs 84 and linkages 92. The push cylinder then pulls the powered roof support to its new position nearer the face and the hydraulic legs 84 are powered to support the roof. The powered roof support is moved approximately 11.5 feet into its second position.

Figure 5:
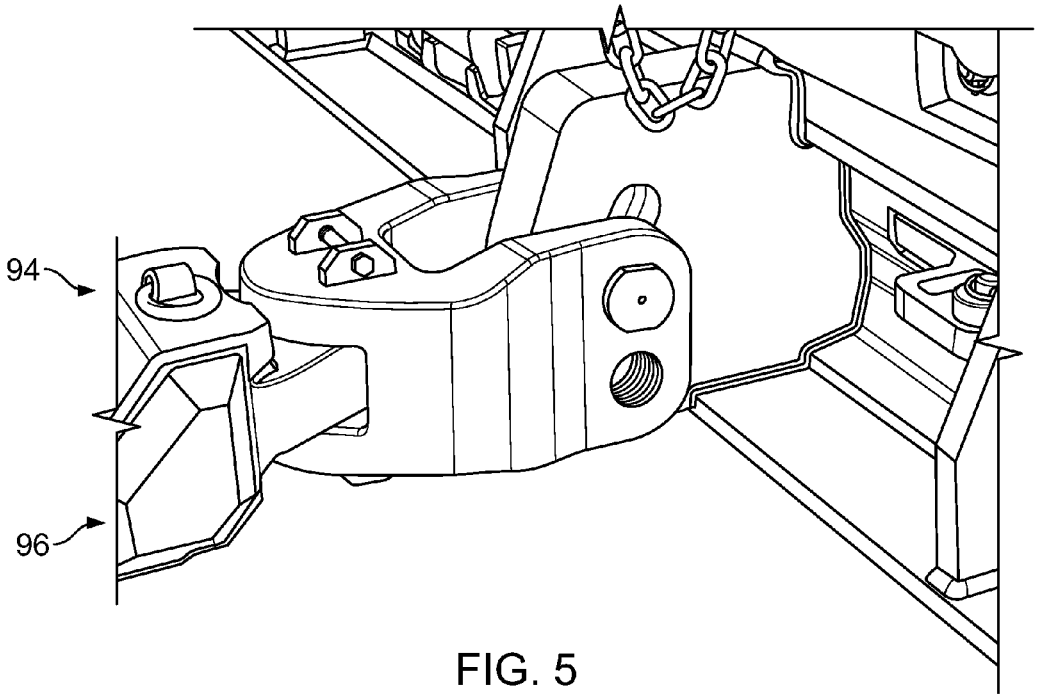
FIG. 5 is a connector between a spill plate and push support of the powered roof support of FIG. 4.

The angled mine layout 10 requires that the roof supports 80 advance in a direction parallel to the headgate 16 but at an angle 22 to the face 15. The adjacent spill plates form a line 20 parallel to the face 15. FIG. 5 shows an angled spill plate connector 94 that attaches the spill plate 90 at the angle 23 to the push cylinder 88. Spill plate connector 94 has a mechanism 96 that is makes angle 23 adjustable for the precise degree required in a specific mine.

Previous shortwall systems used powered roof supports that had a cantilever support that extended from the tip of the canopy to cover the distance. Current generation powered roof supports are larger machines that can span a bigger distance. This application uses currently available powered roof supports that were designed to use in the headgate and tailgate of a longwall setup and use these supports along the face. These supports are larger and more expensive than the roof supports typically used in the face for a longwall system.

Cable Reel

FIGS. 6A-6D illustrate a cable reel 100 mounted on a roof support 81. Cables 34 are attached to the continuous miner at one end while the un-deployed length of the cables 34 are spooled on the cable reel 100. The cable reel 100 is located at an edge of the turn corner 19 and attached to (e.g., mounted on, etc.) a first roof support 81 (i.e., the roof support located at the "beginning" of the face). The cable reel 100 stores, feeds, and receives the cables 34 as described below. Cable reel 100 advantageously organizes and positions the long cables required for the increased length of the face 15 used in the mining layout of the current invention, reaching up to 700 feet. This relatively long face 15 (and associated relatively long length of cable) contrasts to traditional shortwall mining operations which vary between 100 to 200 feet in length.

FIGS. 6A-6D are front and side views of the cable reel 100 attached to the canopy 82 of the first roof support 81. The cable reel is movable between several positions along the canopy 82 (e.g., along an axis of symmetry of the roof support 81). Cables 34 can be reeled and unreeled from the cable reel 100 as more or less cable length is required by the movements of the continuous miner 30.

A cable reel assembly 101 is mounted to the powered roof support via a rotating mount or turntable 112, and is capable of rotation about two distinct axes. The cable reel assembly includes a cable spool 106 which is rotatable around a first axis parallel to the surface of the canopy 82. As the cable spool 106 rotates about this axis the cables 34 are reeled and unreeled from the cable spool 106. The cable assembly 101 also includes a cable spooling guide 108 which restricts the motion of the cables 34 such that they leave the body of the cable spool 106 at a determined location. The cable reel assembly 101 is rotatable about a second axis perpendicular to the first axis and perpendicular to the canopy 82. Rotation about this second axis allows the entire cable reel assembly 101 to rotate relative to the canopy 82. This second rotation is facilitated by the turntable 112 and permits the cable spooling guide 108 to move and, for example, track the movement of the continuous miner 30 as it turns through angle 23 at the turn corner 19.

Figure 9A:
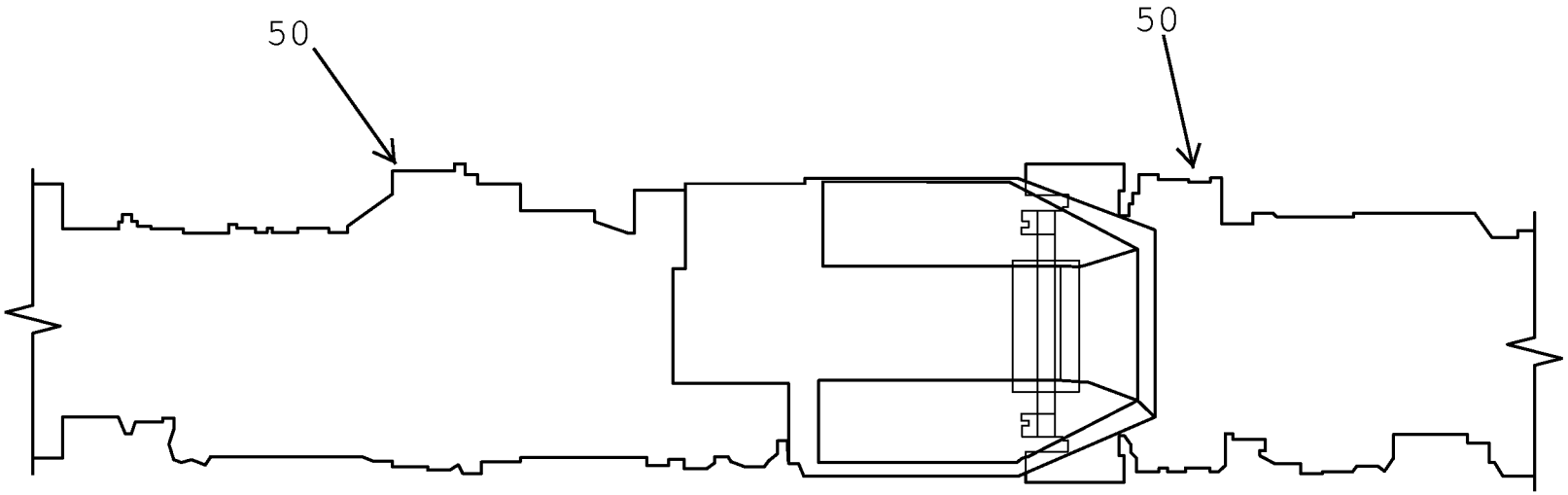
FIGS. 9A-9D are schematics of two flexible conveyor trains connected in series.
Figure 9B:
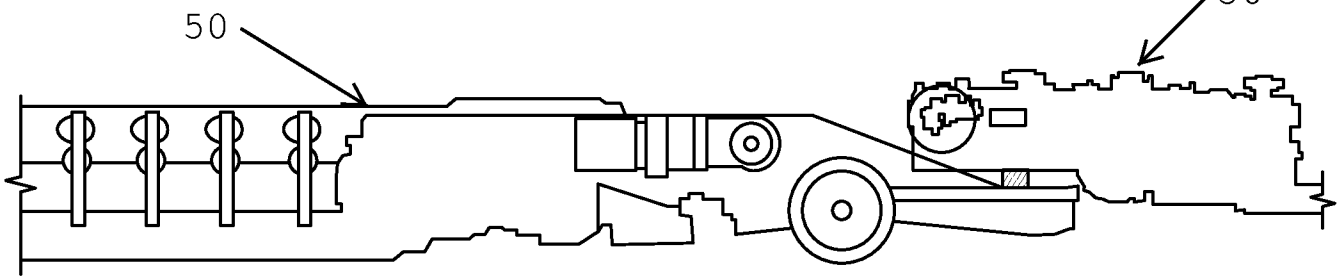
Figure 9C:
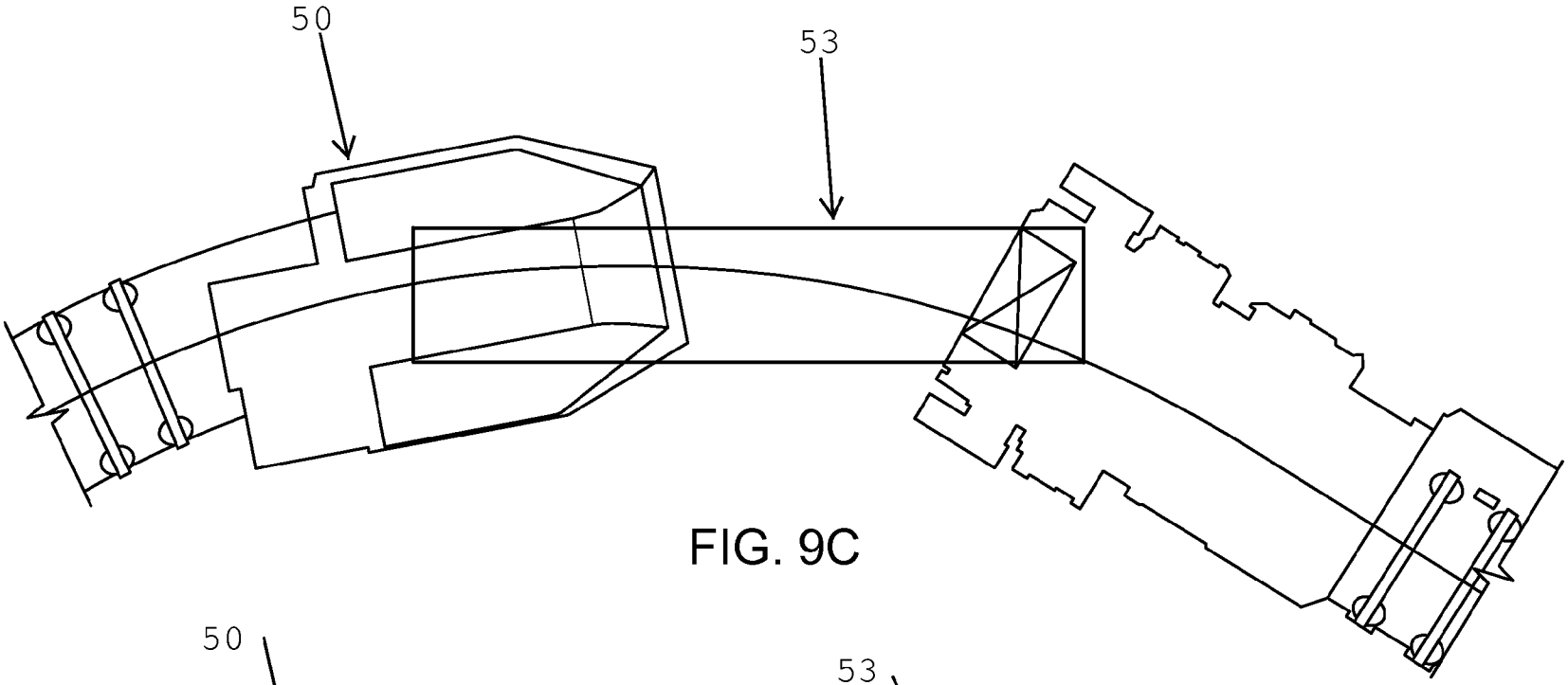
Figure 9D:
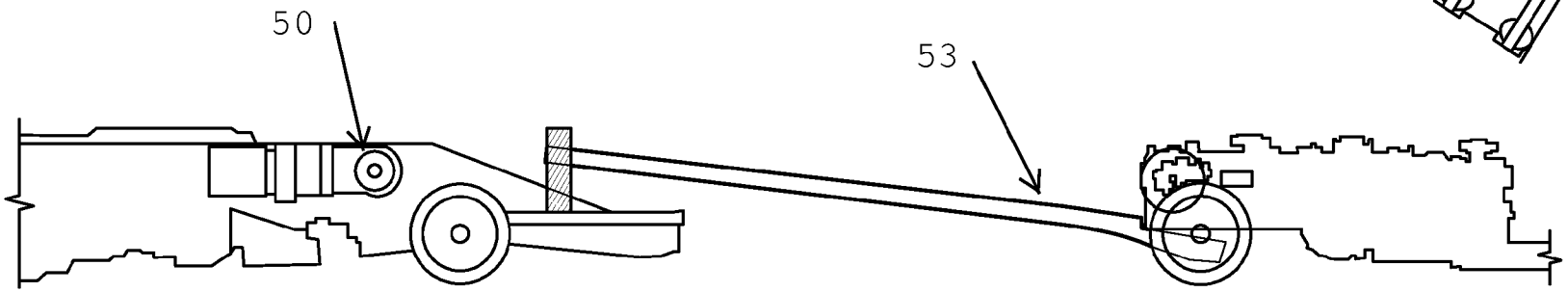

The cable reel assembly 101 is positioned along the powered roof support by a hydraulic positioning jack. The positioning jack 104 translates along guide rails 110 that extend along the canopy 82. In FIG. 6A, the cable reel 100 is in an extended position 100*a*, at the end of the first roof support 81 closest to the face 15. In this position, the cable reel is substantially aligned with continuous miner as the continuous miner proceeds along the face. FIG. 9B shows the cable reel 100 in a retracted position away from the face 15. The distance between the two positions 100*a* and 100*c* is chosen to minimize the translation of the cable reel 100 while providing clearance for the machines running under the canopy 82 of the first roof support 81. For example, this distance can be 4.12 feet.

Movements of the cable reel 101 can be controllable by remote control. For example, the timing and speed of positioning of cable reel 100 in its various positions (e.g., to position 100*a*, 100*b*, 100*c*) can be controlled by an operator located in the mine. The speed of rotation of cable spool 106 as it takes in or feeds out cables 34 can be variable, and can be controlled by an operator. Alternatively movement and positioning can be done automatically. The automation may be part of the guidance system described below.

Mining Sequence

Figure 7A:
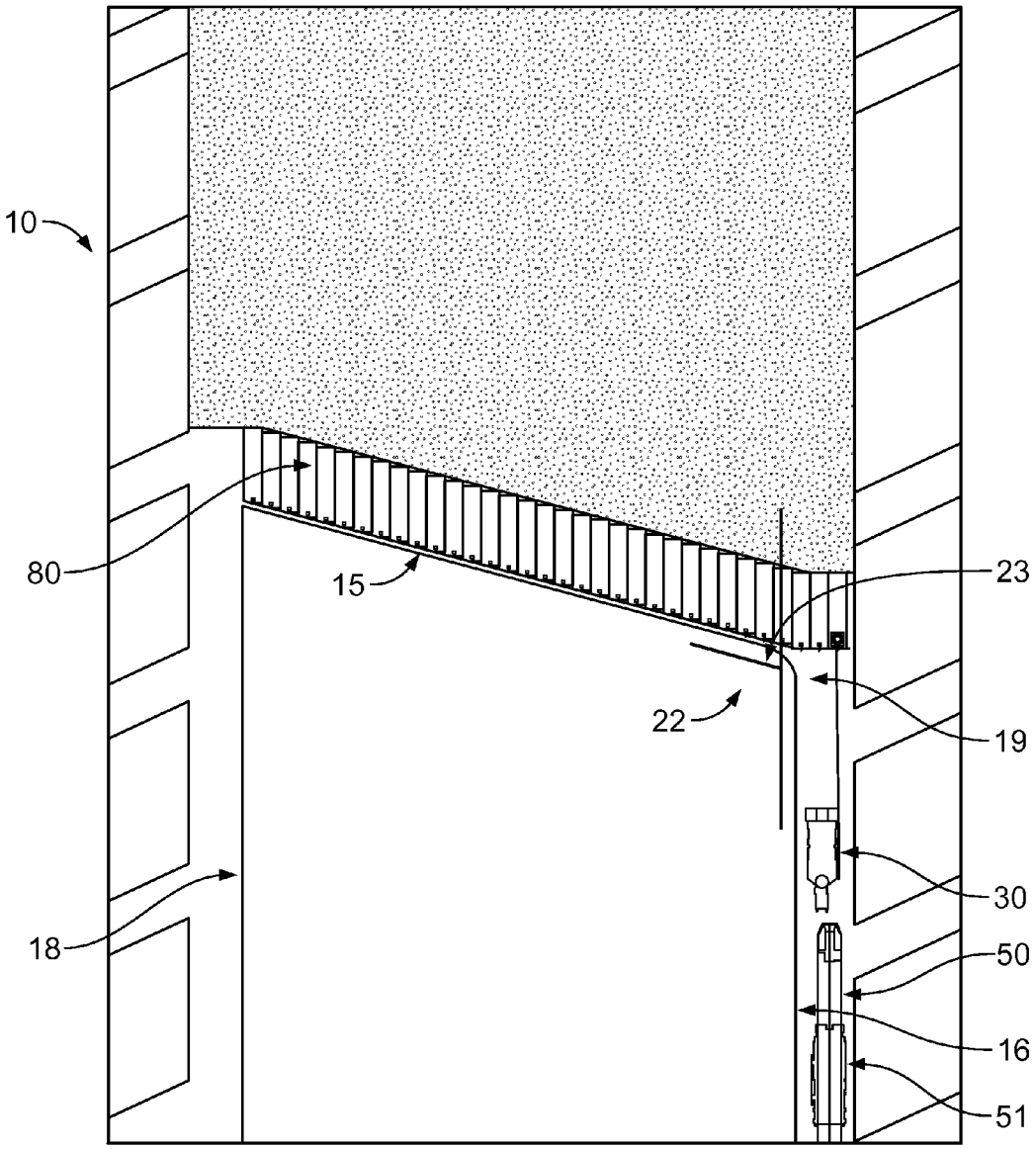
FIGS. 7A-7J illustrate a mining operation sequence in the angled mine layout of FIG. 1.
Figure 7B:
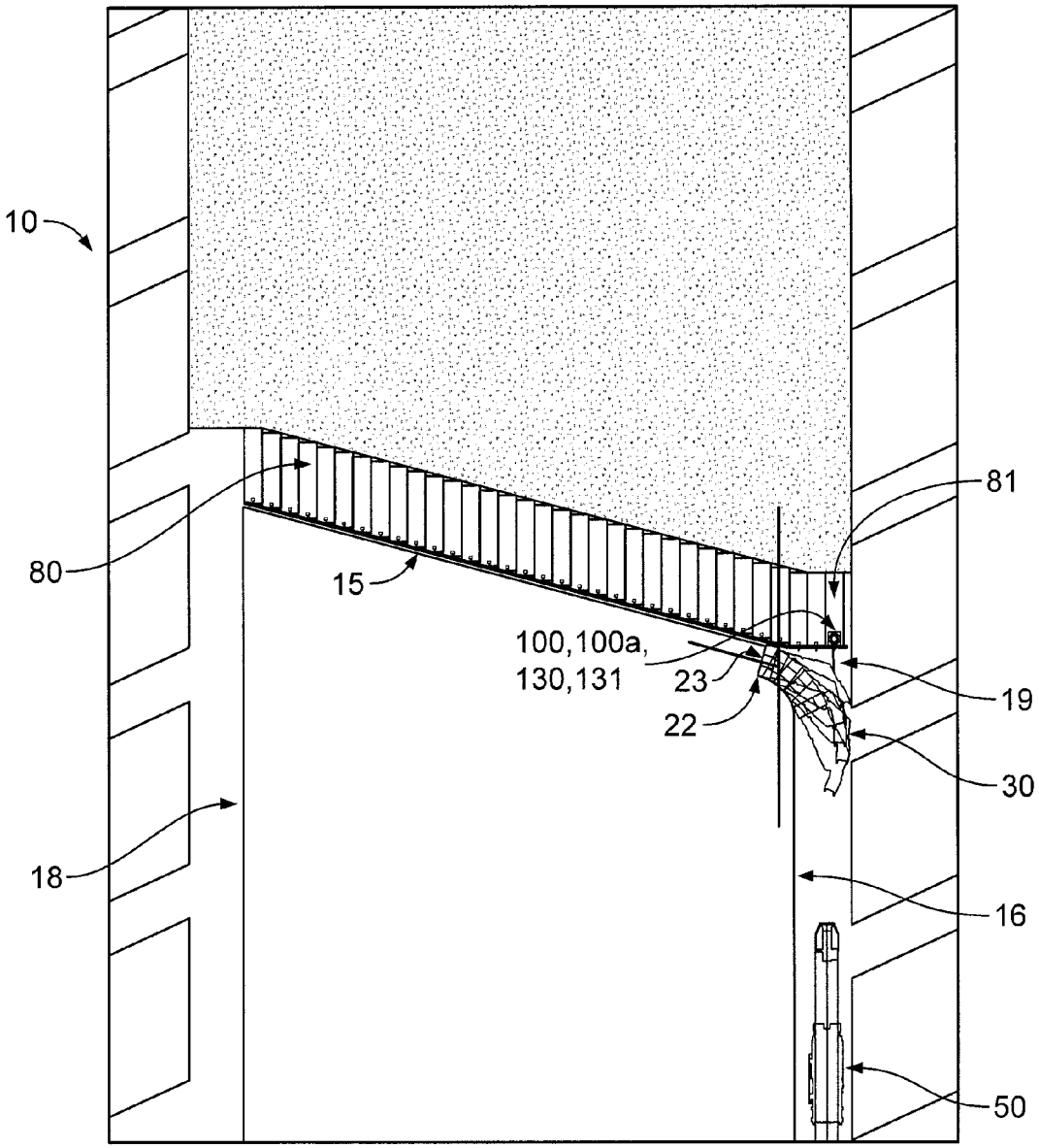

FIGS. 7A-7I illustrate exemplary mining operations implementing the equipment and layout described above. To extract material from the angled mine layout 10, a continuous miner 30 approaches a face 15 in a generally straight line along the headgate 16 (see FIG. 7A). When the continuous miner 30 reaches the turn corner 19, it must change orientation to parallel to the face 15 which it does by turning through angle 23 as shown in FIG. 7B. Angle 23 is less than the 90 degrees traditionally used in mining operations. In some embodiments, while executing the turn the continuous miner 30 performs a preliminary cutting operation, partially embedding the cutter drum 32 into the solid material of the subterranean formation adjacent the face 15 and positioning the continuous miner to extract material in a straight line parallel to the face 15.

Turn corner 19 must be kept substantially free of equipment or blockages to allow for the passage and movements of the continuous miner 30 and the flexible conveyor train 50. As a consequence, the roof supports 80 must be maintained in a location to provide adequate clearance for the mobile equipment (e.g., the continuous miner). In a traditional wall mining layout, previously installed roof bolts provide protection along the headgate and tailgate and the powered roof supports provide protection along the face. However, use of a continuous miner can require removal of a portion of the coal panel to smooth the corner between the headgate 16 and the face 15. Depending on the distance to the existing installed roof bolts/powered roof supports, roof bolting can be required in the turn corner. Since the angle 23 between the face 15 and the headgate 16 is less than 90 degrees in the angled mine layout 10, the area of turn corner 19 is reduced compared to a traditional wall mining layout. This reduction in roof area can reduce or eliminate the need to perform roof bolting at the turn corner with associated savings in time and costs.

Figure 6B:
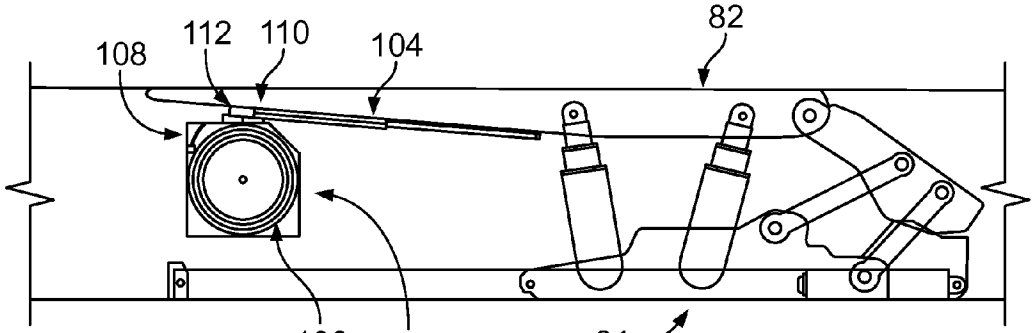
FIGS. 6A-6D are schematic front and side views of cable reel mounted on a powered roof support.
Figure 6A:
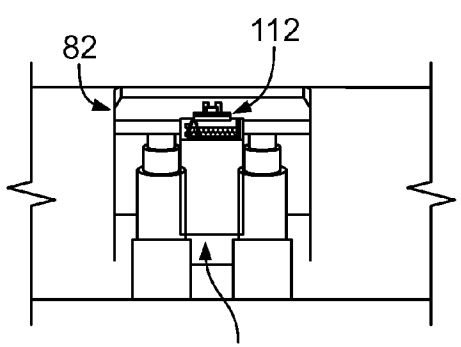
Figure 6D:
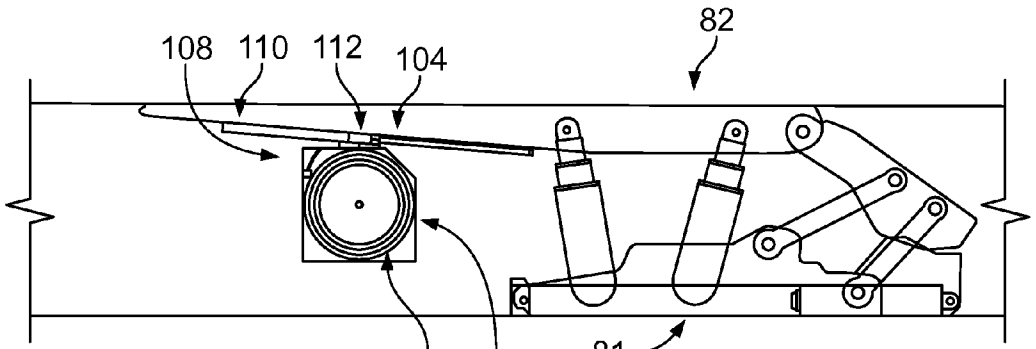
Figure 6C:
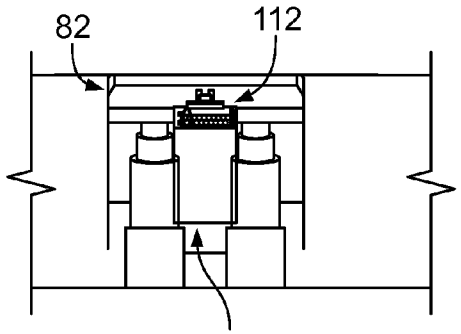

During the turning operation of the continuous miner at turn corner 19, the cable reel 100 is at a retracted position relative to the body of the first roof support 81 (see FIG. 6B). The retracted position can help to keep the cable and cable reel out of the way while the continuous miner 30 executes its turning and preliminary cutting operations. In general, the cable reel 100 unreels the shortest possible length of cables 34 possible to reach the continuous miner 30 and permit it to move easily with the cable 34 either suspended or lying along the ground but does not unnecessarily tension the trailing cable 34.

Figure 7C:
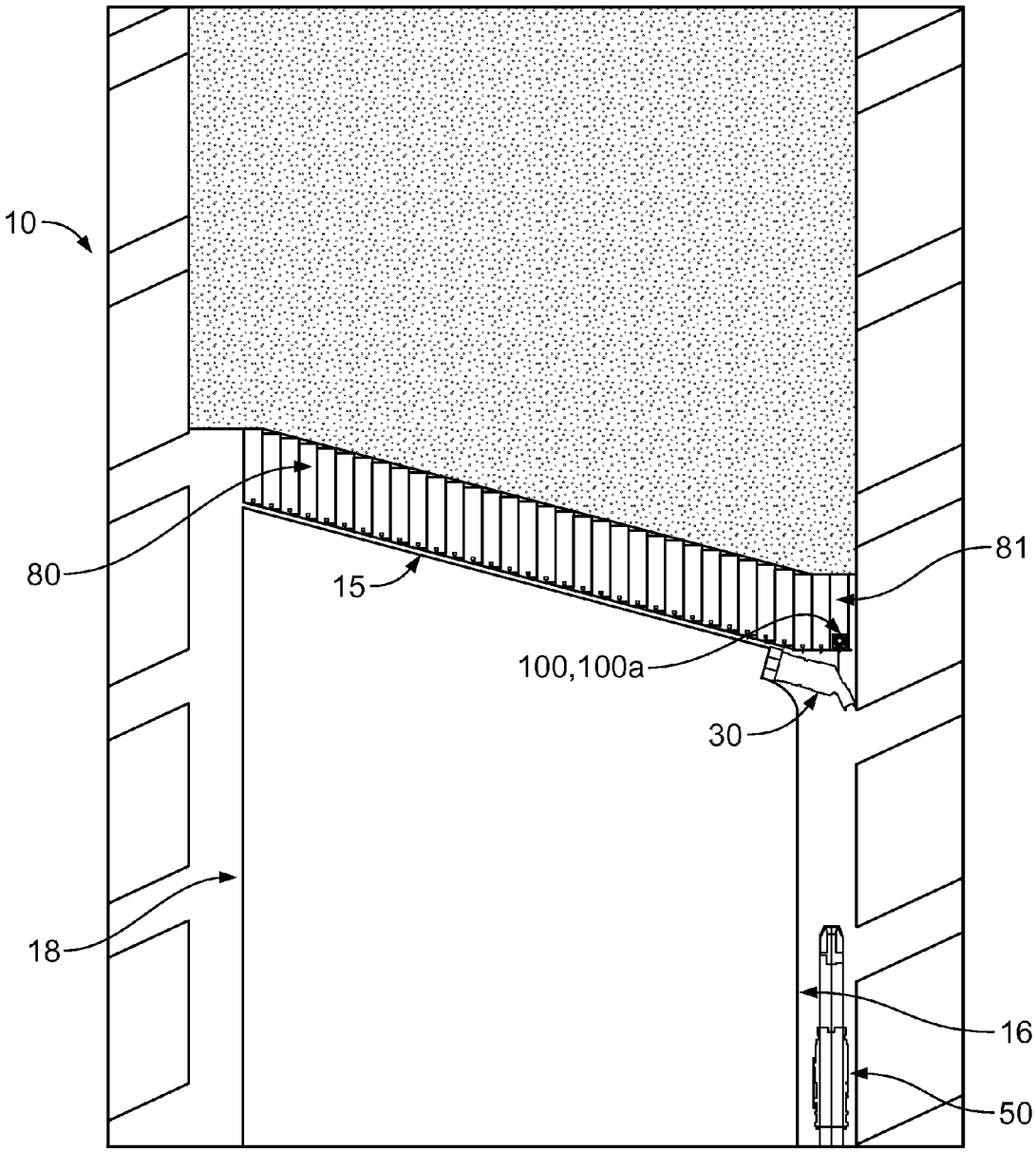

FIG. 7C shows the continuous miner 30 angled and ready to cut coal from the face 15, having completed its turn at the turn corner 19. The continuous miner 30 is located within the turn corner 19 with the rotating cutter drum 32 at the front end of the continuous miner 30 facing and partially embedded in the solid material to be cut and removed. The body of the continuous miner has completed its maneuvering past the first powered roof support 81 and the attached cable reel 100.

Figure 7D:
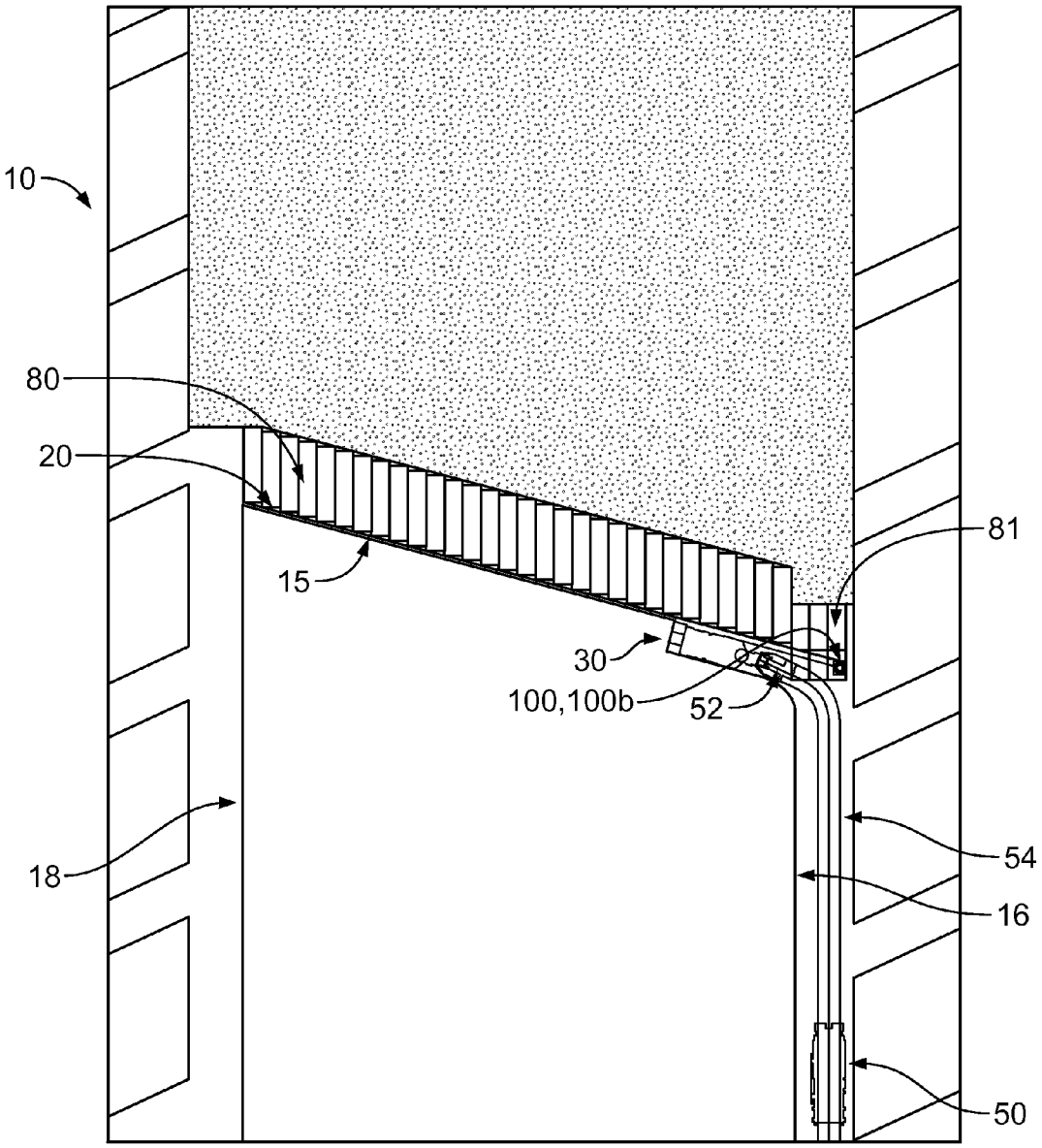

Prior to making a cutting operation across the face 15, the flexible conveyor train 50 is positioned immediately behind the continuous miner 30, as shown in FIG. 7D. The flexible conveyor train 50 follows the continuous miner 30 as the continuous miner 30 cuts a path along the face 15 and provides continuous material clearance for the continuous miner 30. The flexible conveyor train 50 can convey coal away from the face at flow rates up to 27 tons/minute and can convey salt, trona, gypsum or potash at up to 40 tons/minute.

As the continuous miner 30 and flexible conveyor train 50 perform their combined material extraction and removal process across the face 15, the location of the face 15 moves. The powered roof supports 80 likewise move, translating themselves forward from an initial position near the first location of the face 15 to second position near the second location of the face 15. As shown in FIG. 7D, roof support 81 and the two adjacent roof supports have advanced from their previous position as seen in FIG. 7C. The movement, or stroke, of the roof supports is approximately the width of material removed from the continuous miner 30. This width can be between 10 and 13.5 feet, e.g., 11.5 feet wide. Different width continuous miners can be used for different applications. In their second position, the roof supports support the roof just created by the passage of the continuous miner 30.

As the continuous miner 30 and flexible conveyor train 50 begin their combined material extraction and removal movement across the face 15, the cable reel 100 moves to its extended position. In its extended position, the cable reel 100 has moved away from both the spill plate 90 and face 15 and the cable reel 100 is positioned for the continuous miner 30 to make its mining operation such that the trailing cable 34 is free from encumbrances such as the spill plate 90. In some embodiments, the spill board above the dozer blade on the powered roof supports defines a cable trough through which the trailing cable 34 extends. In some embodiments, the trailing cable 34 lays on the floor.

Figure 7E:
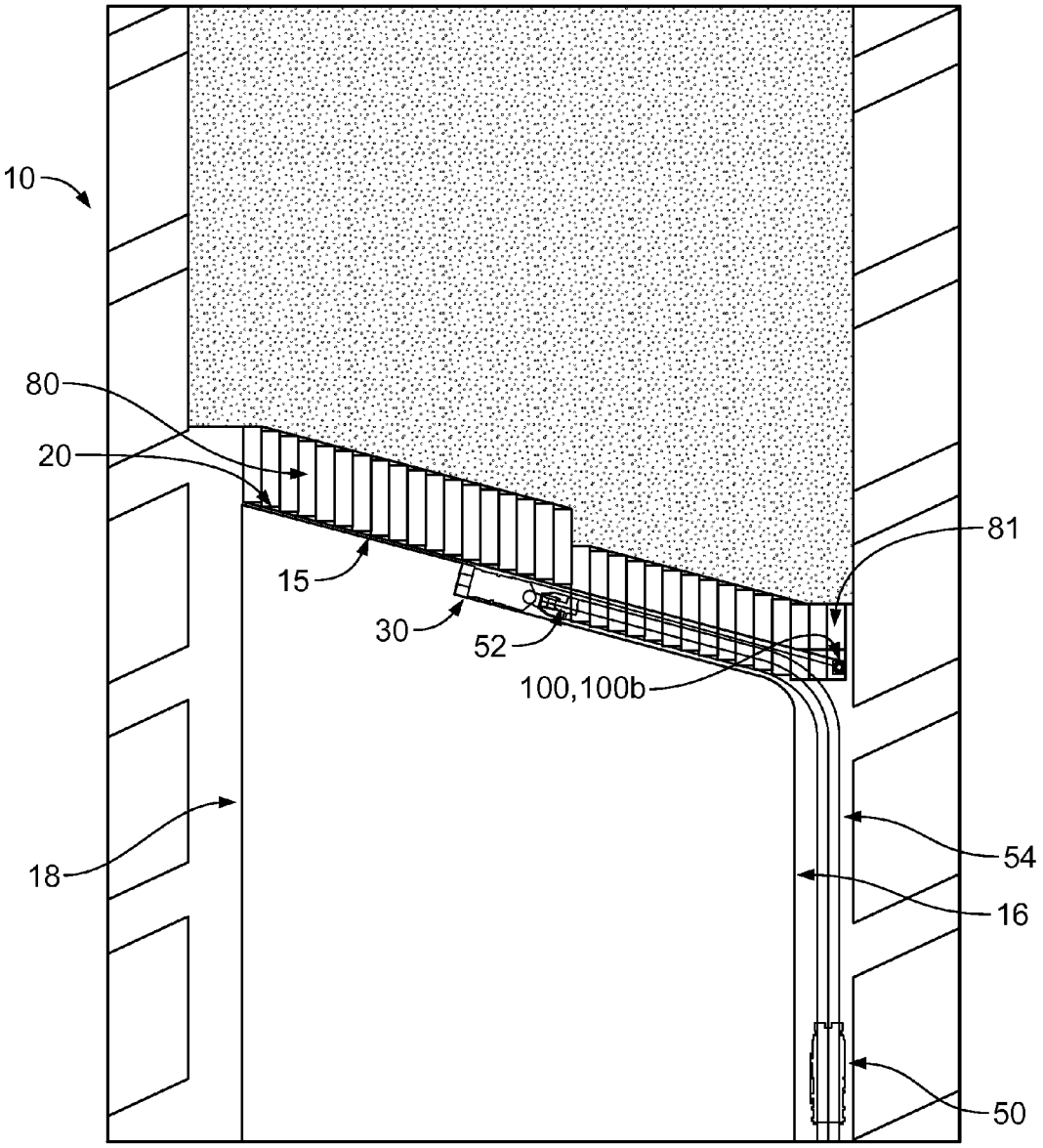
Figure 7F:
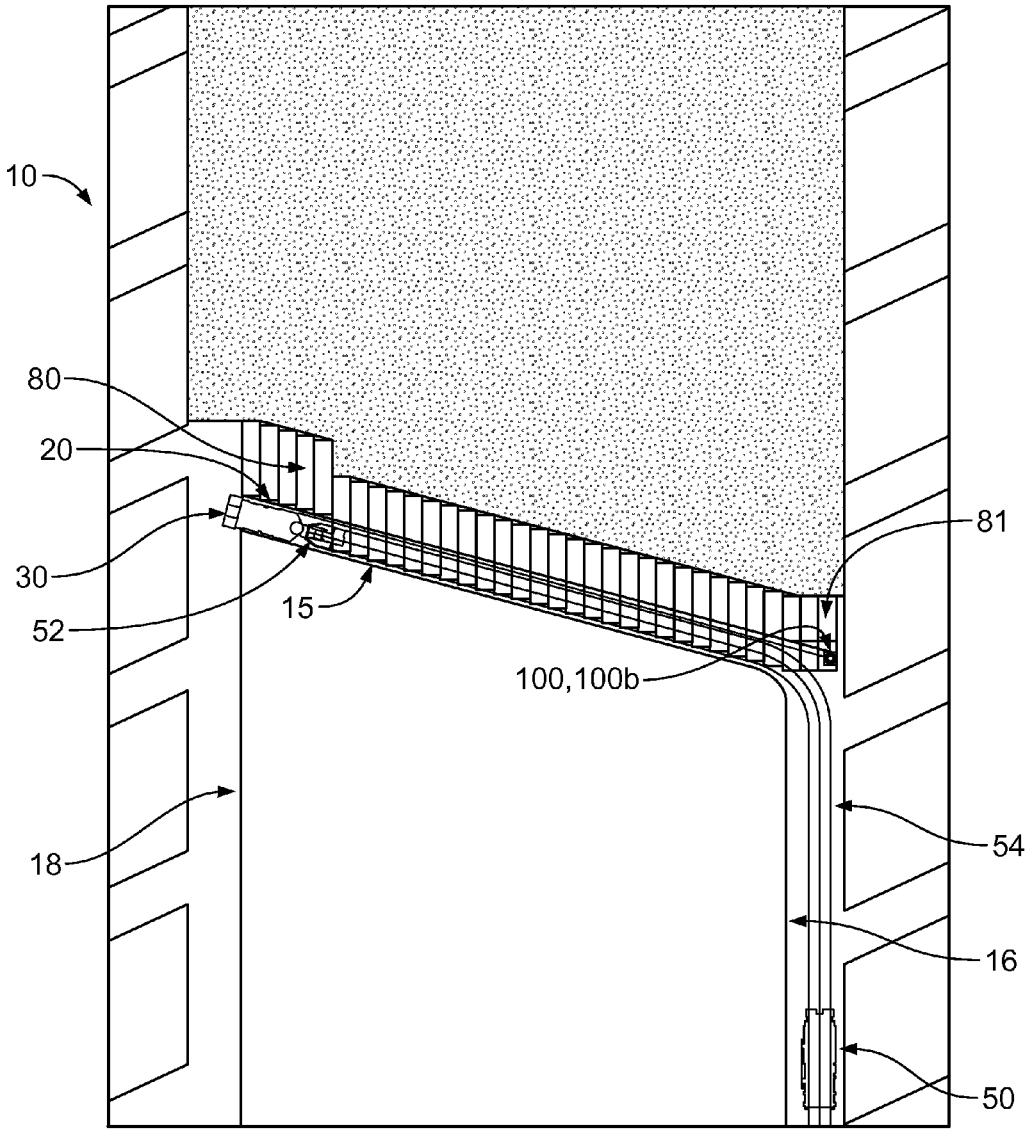
Figure 7G:
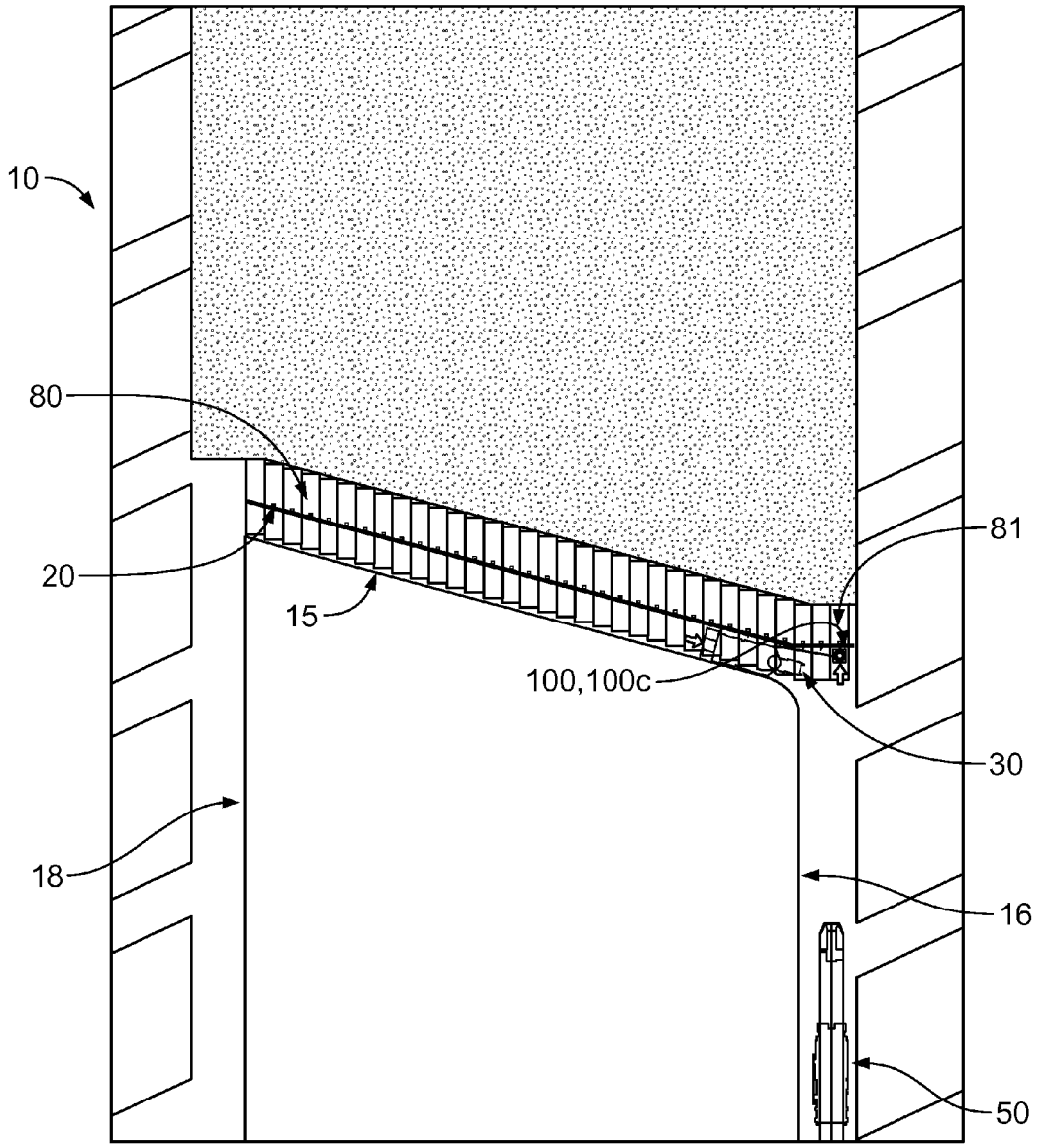

As shown in FIGS. 7D-7F, the roof supports 80 advance to their respective second positions in coordination with the passage of the continuous miner 30. In FIG. 7E, continuous miner 30 is approximately half way across the face 15 and accordingly approximately half of the powered roof supports 80 have advanced to their respective second positions. Cable reel 100 unspools trailing cable 34 as the continuous miner advances with the trailing cable 34 lying underneath the canopies 82 of the advanced roof supports 80, not interfering with the mining operation.

In FIG. 7F, the continuous miner 30 (and flexible conveyor train 50) has reached the tailgate 18 at the "end" of the face 15. Trailing cable 34 can be at its full extension at this point. Materials along the face (except for any spilled materials) have been extracted by the continuous miner 30 and removed from the face 15 by the flexible conveyor train 50. The powered roof supports 80 located out by the continuous miner have moved to their second positions.

This advance of powered roof supports 80 happens automatically due to a guidance system 130 coordinates the movement of the continuous miner 30 with the roof supports 80 using the dozer blades 90. In some embodiments, the position of the continuous miner is indexed based on the position of the FCT as determined from the tailpiece by positioning software. The zero position can be or by a sensor that identifies when the continuous miner goes past the first powered roof support. In some embodiments, the position of the continuous miner is indexed based on the cable reel. The zero position can be triggered manually or by a sensor 131 that recognizes when the cable reel pivots as the continuous miner proceeds down the face 15. This software interfaces with the powered roof support programming to identify when the powered roof supports would receive a computer command to lower, advance and reset.

Once the continuous miner cutter head 32 has made contact with the tailgate 18 as shown in FIG. 12, the continuous miner pass is complete. The face 15 has advanced approximately 11.5 feet, or the width of the material removed by the continuous miner 30. The continuous miner 30 and flexible conveyor train 50 are ready to be withdrawn along the face 15. The direction of travel of the flexible conveyor train 50 is reversed, and it is removed from the face and returned to its original position (see FIG. 7G). The continuous miner is also backed up along the face 15 and as it passes, the final roof supports 80 located near the tailgate 18 move to their respective second positions. As the continuous miner 30 reverses toward the first roof support 81, the cable reel reels in the trailing cable 34 moving the cable out of the way of the retreating continuous miner 30. As the continuous miner approaches the turn corner, the cable reel 100 is repositioned to its retraced position moving it out of the way of the retreating continuous miner 30.

Figure 7H:
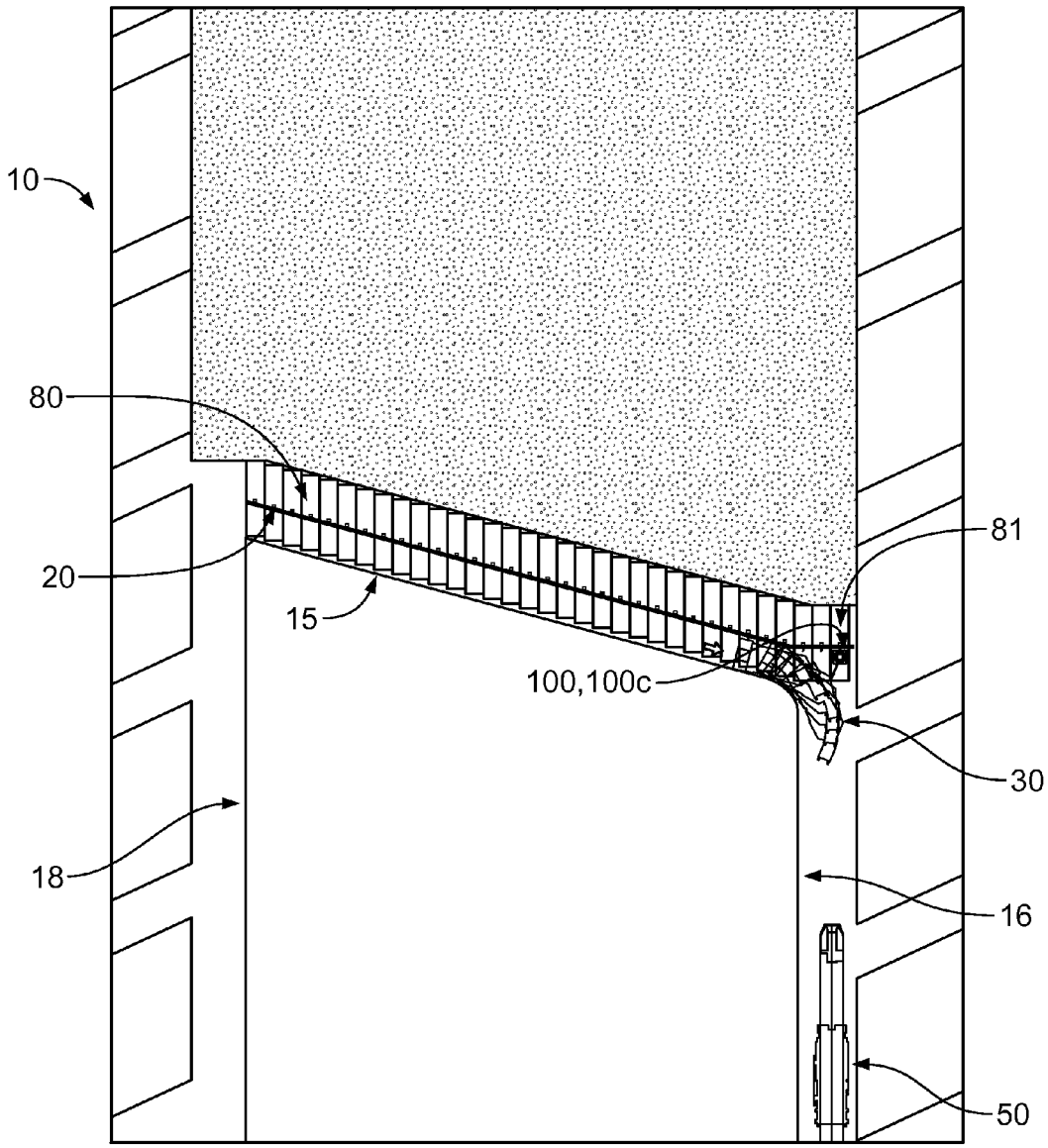

As shown in FIG. 7H, the continuous miner 30 turns through angle 23 to parallel with the headgate 16. The cable assembly 101 rotates on turntable 112 to accommodate the change in angle in its retracted position giving maximum maneuvering space and clearance to the continuous miner 30.

Once the continuous miner 30 has fully entered the headgate 16 and is out of the way, the spill plates 90 attached to the row of roof supports 80 advance approximately 11.5 feet, pushing any spilled material out of the way. The cable reel 100 returns to its extended position to prepare for the next continuous miner cut. This extended position is behind the spill plate and allows personnel clearance behind the cable reel.

Figure 7I:
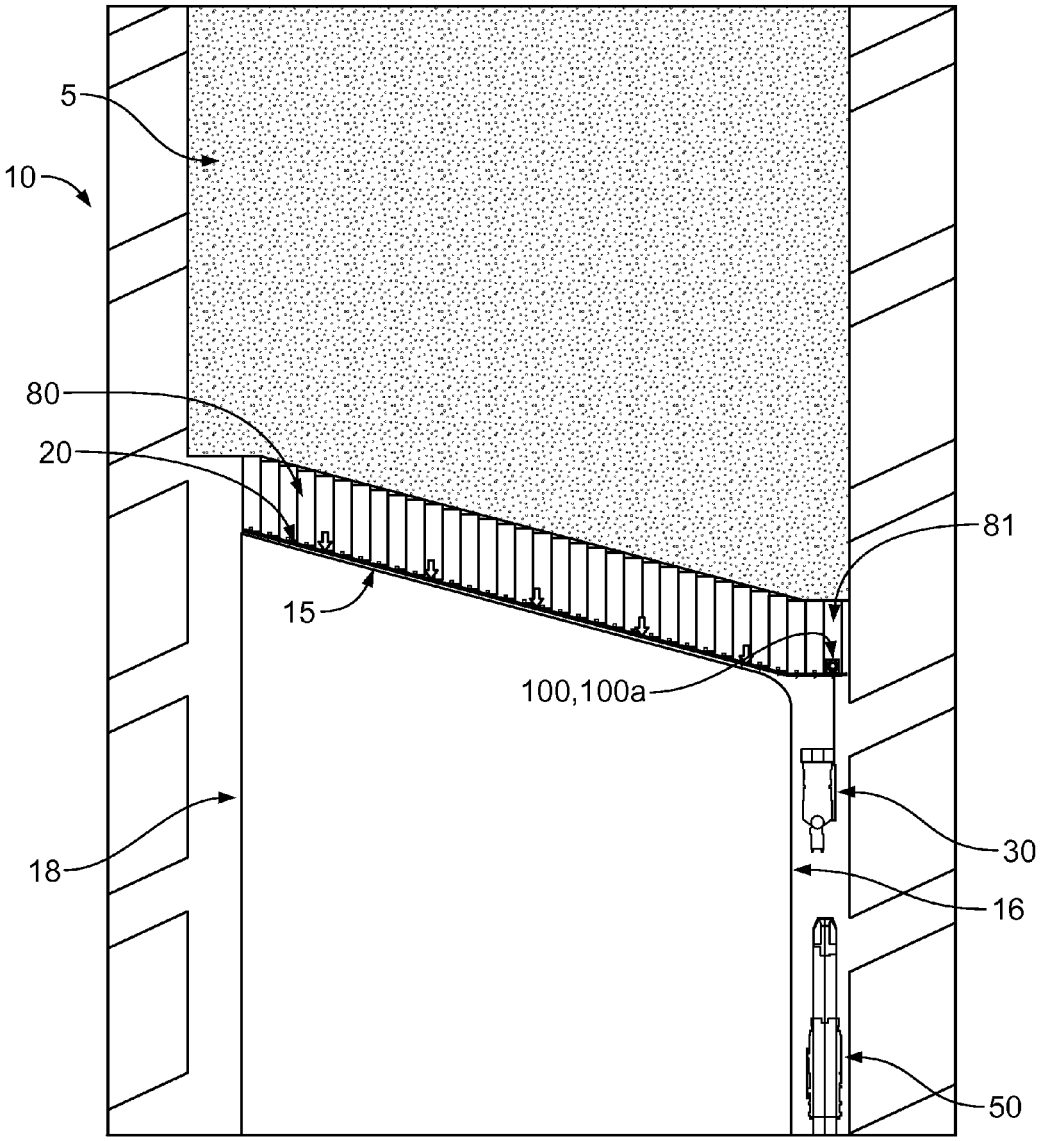
Figure 7J:
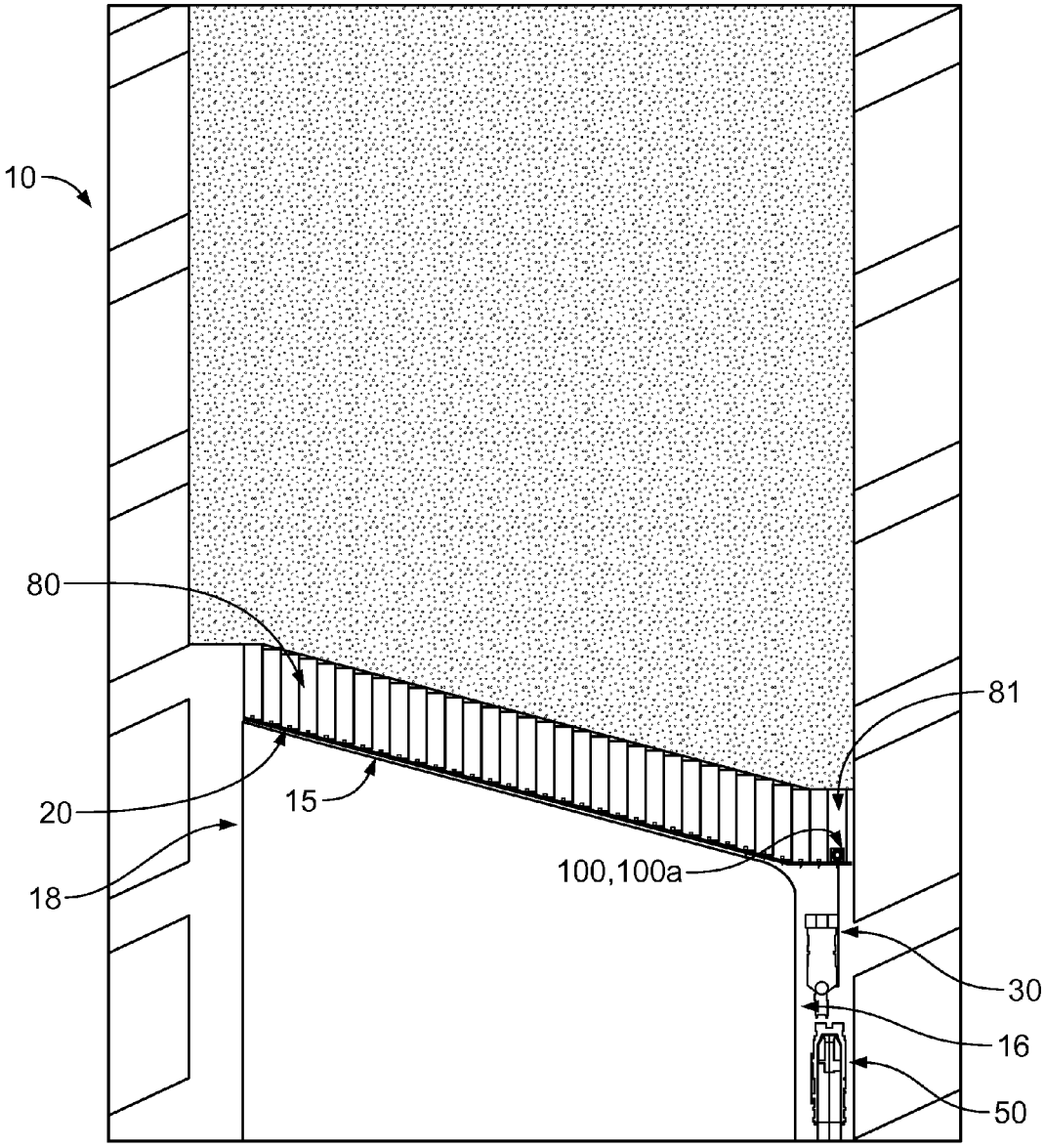

The steps as described above are repeated multiple times as the material is extracted from the mine 10. With each repetition, the face 15 moves closer towards the start of the panel, as shown in FIG. 7I. As the face 15 advances, the extracted area 5 increases behind the line of roof supports 80. As personnel and equipment are no longer in the extracted area 5, the mine roof can safely be allowed to collapse behind the structural line of roof supports 80 without danger to either operators or the mining operation. When the face 15 reaches the end of the dynamic move-up unit (DMU) 51 as shown in FIG. 7J, the section belt and DMU are moved back to start a new cycle.

Figure 8A:
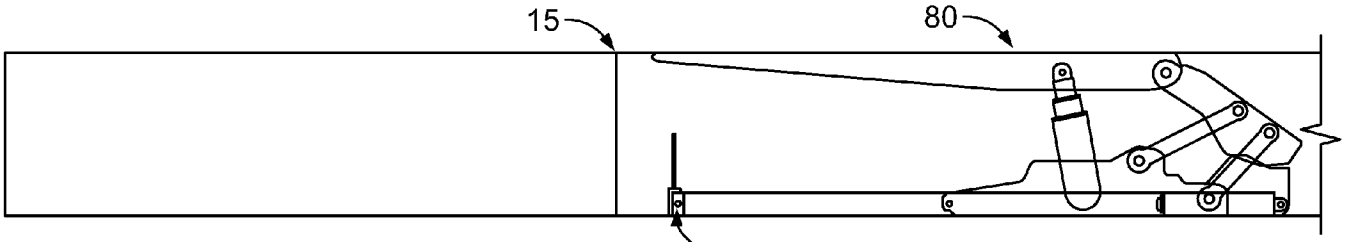
FIGS. 8A-8E are schematic side views of the angled mine layout of FIG. 1.

FIGS. 8A-8E show the angled face mine layout 10 is shown in partial cross section parallel to the headgate and at a plane intersecting the face 15 at any plane between first roof support 81 and the tailgate 18. FIG. 8A shows a plane of interest prior to a mining cut, with the continuous miner 30 and flexible conveyor train 50 located either closer to (i.e., near the "beginning" of the mine) or in the headgate 16. The flexible conveyor train 50 deploys off of and retracts onto a dynamic move-up (DMU) tailpiece which is the start of the section belt. The powered roof support 80 is supporting the mine roof adjacent to the face 15, and the spill plate 90 is in its extended position.

Figure 8B:
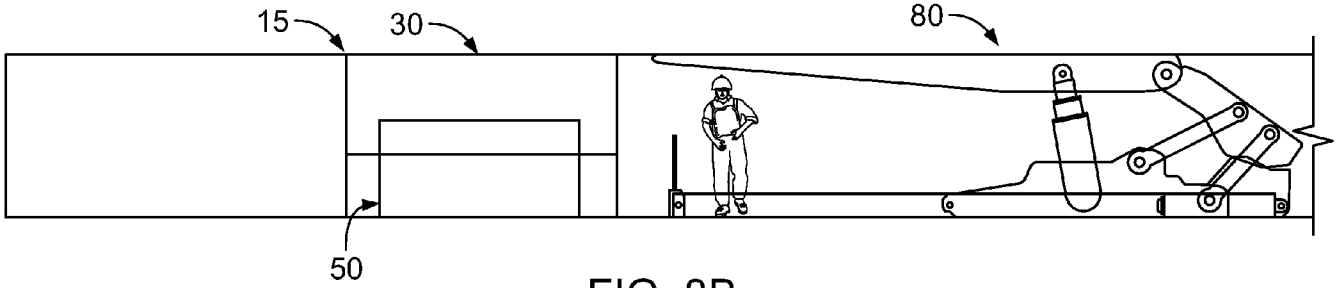

The continuous miner 30 and the flexible conveyor train 50 make their combined material cutting and removal pass along the face 15 and have reached the cross section of interest in FIG. 8B. The passage of the mining machines moves the face 15 from its original position in FIG. 8A to its new position in FIG. 8B approximately 11.5 feet away. At this moment there is an approximately 11.5 foot wide unsupported roof area between the face 15 and the roof support 80. The guidance system guides the continuous miner 30 as well as coordinates its passage with the movements of the roof supports 80.

Figure 8C:
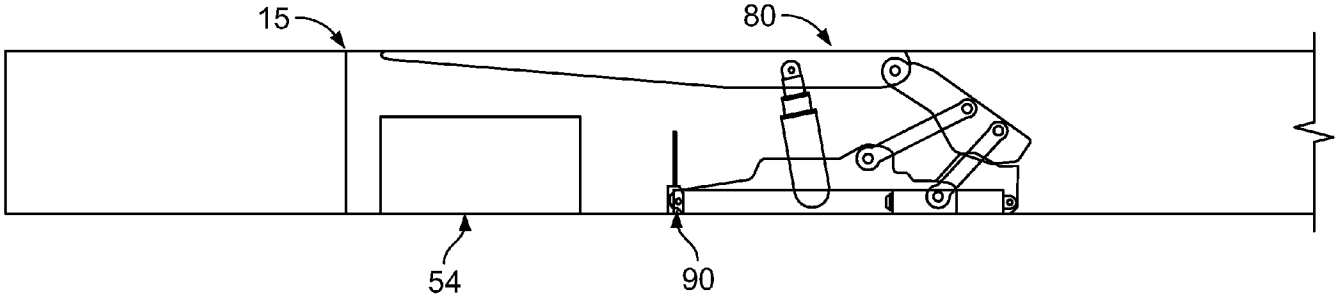
Figure 8D:
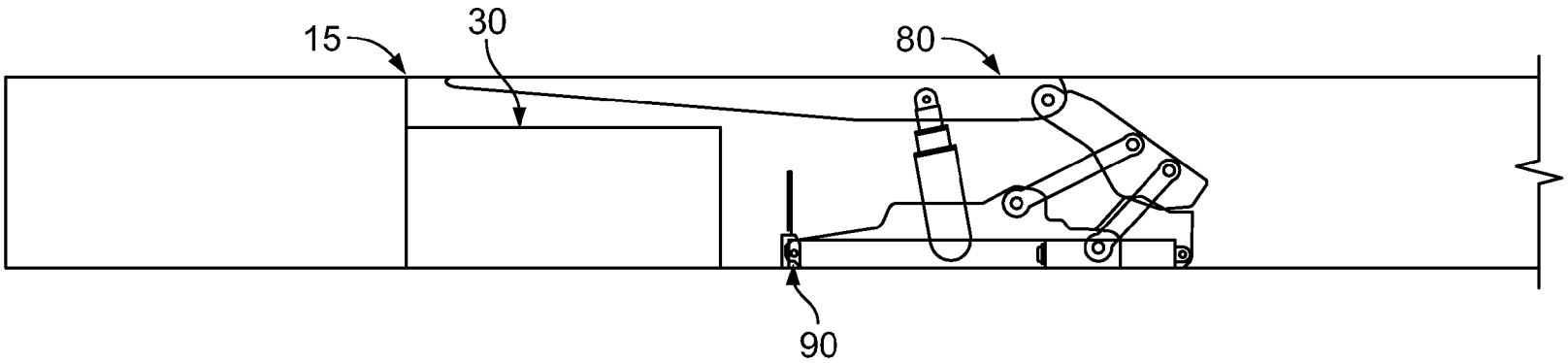

The continuous miner 30 continues its mining operation closer to the tailgate, while the flexible conveyor train 50 continues to follow, FIG. 8C. The conveyor 54 of the flexible conveyor train lies along the entire face 15 including the plane of interest. In response to the guidance system, the roof support 80 performs its advancing operation, drawing the base 86 towards the spill plate 90, and advancing the canopy 82 to cover the unsupported roof expanse. As discussed above, this advance of powered roof supports 80 happens automatically due to a guidance system 130 coordinates the movement of the continuous miner 30 with the roof supports 80 using the dozer blades 90.

The roof supports can be advanced individually or sets of roof supports can be advanced together. The roof supports can be advanced in a single stroke or they can be advanced by sequencing the roof supports multiple times.

Once the continuous miner 30 finishes its cut across the face 15 and reaches the tailgate 18, the material removal steps for this mining cycle have been completed. The flexible conveyor train 50 is withdrawn, snaking backwards and out by along the face. The cutter drum 32 on the continuous miner 30 is lowered to a non-cutting position, decreasing the effective height of the continuous miner 30. The continuous miner then retreats backward along the face 15, passing under the canopies 82 which have moved to support the newly mined roof, FIG. 8D.

Figure 8E:
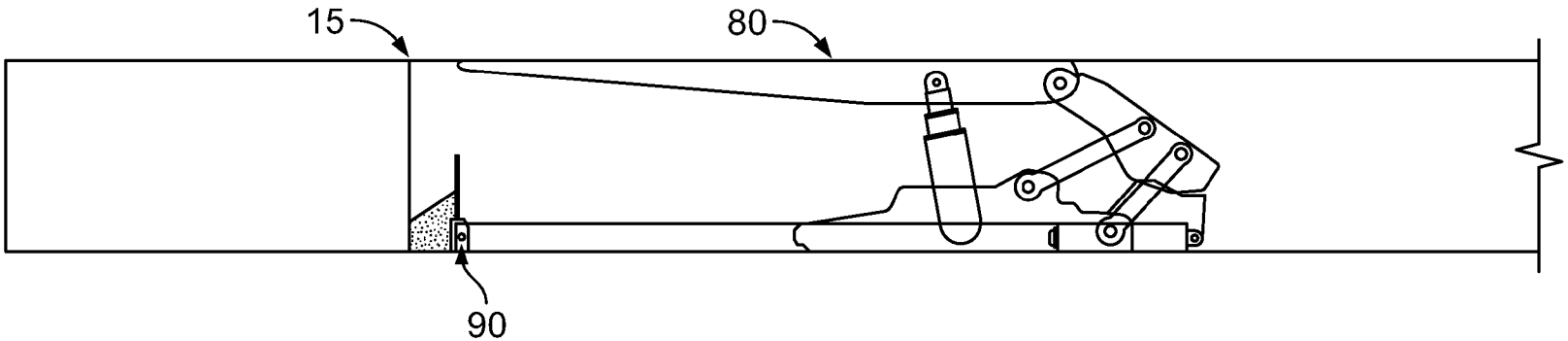

The spill plate 90 advances to its extended position when both the continuous miner 30 and the flexible conveyor train 50 are repositioned in the headgate 16, FIG. 8E. This pushes any spilled materials left by the mining machines near the new face 15 such that the continuous miner 30 can remove them on the next pass and positions the roof support 80 into the ready position for its next advancing movement.

In some embodiments, multiple flexible conveyor trains 50 can be used in series to remove material from the face 15. The use of multiple flexible conveyor trains 50 in series can extend the length of the face 15 which can be mined using this approach. The first 30 feet and the last 30 feet of the flexible conveyor train 50 are not flexible. In some implementations, a first flexible conveyor train 50 is linked to a second flexible conveyor train 50 such that the second flexible conveyor train 50 receives coal discharged by the first flexible conveyor train 50 as illustrated in FIGS. 9A-9D. The coupling of the inflexible last 30 feet of the first flexible conveyor train to the inflexible first 30 feet of the second flexible conveyor train can prevent the junction between the first and second flexible conveyor trains from passing the turn corner between the maingate 16 and the face 15. This configuration can limit the length of the face 15 to the length of the available flexible conveyor train. In some implementations, a mobile bridge 53 is used to couple the discharge of the first flexible conveyor train 50 to the inlet hopper of the second flexible conveyor train 50 as illustrated in FIGS. 9A-9D. This configuration can provide additional articulation joints and allow the inlet hopper of the second flexible conveyor train 50 to pass the turn corner and proceed along the face 15.

A number of embodiments of the invention have been described. Nevertheless, it will be understood that various modifications may be made without departing from the spirit and scope of the invention. For example, in some embodiments, the fan and air scrubber system on the continuous miner is removed or de-activated as positive air flow along the face towards the tail gate eliminates the need for air control and treatment on the continuous miner. Accordingly, other embodiments are within the scope of the following claims.

What is claimed is:

1. A system for extracting material from subterranean formation, the system comprising:
- a continuous miner;
- at least one flexible conveyor train;
- a plurality of powered roof supports,
- a main gate entry;
- a tailgate entry connected to the maingate entry by an active mine face;
- wherein the active mine face extends at an angle between 95° and 135° relative to the maingate entry and the active mine face extends between 200 feet and 700 feet from the maingate entry to the tailgate entry.

2. The system of claim 1, wherein the angle is less than 130°.

3. The system of claim 2, wherein the angle is greater than 100°.

4. The system of claim 3, comprising multiple flexible conveyor trains disposed such that a discharge of a first flexible conveyor train and an inlet of a second flexible conveyor train are located such that the inlet of the second flexible conveyor train receives extracted material discharged from the first flexible conveyor train.

5. The system of claim 4 comprising a guidance system operable to receive a location signal based on relative location of the continuous miner along the face and to send a control signal to the plurality of powered roof supports positioned along the face.

6. The system of claim 5, comprising a cable reel assembly operable to store, feed, and receive a cable attached to the continuous miner.

7. The system of claim 6, wherein the cable reel assembly is mounted on one of the plurality of powered roof supports.

8. The system of claim 7, wherein each of the plurality of powered roof supports is movable between a retracted position and an extended position supporting at least 11 linear feet of roof more than the retracted position.

9. The system of claim 7, comprising a power cable extending from the cable reel to the continuous miner.

10. A system for extracting material from subterranean formation, the system comprising:
- a main gate entry;
- a tailgate entry connected to the maingate entry by an active mine face, wherein the active mine face extends at an angle between 95° and 135° relative to the maingate entry;
- a continuous miner;
- at least one flexible conveyor train; and
- a plurality of powered roof supports.

11. The system of claim 10, comprising a cable reel assembly operable to store, feed, and receive a cable attached to the continuous miner.

12. The system of claim 11, wherein the cable reel assembly is mounted on one of the plurality of powered roof supports.

13. The system of claim 12, comprising a guidance system operable to receive a location signal based on relative location of the continuous miner along the face and to send a control signal to the plurality of powered roof supports positioned along the face.

14. The system of claim 13, comprising a power cable extending from the cable reel to the continuous miner.

15. The system of claim 14, wherein the angle is between is less than 130°.

16. The system of claim 15, wherein the angle is greater than 100°.

17. The system of claim 16, wherein the active mine face extends between 100 feet and 700 feet from the maingate entry to the tailgate entry.

18. The system of claim 17, wherein the active mine face extends more than 200 feet from the maingate entry to the tailgate entry.

19. A system for extracting material from subterranean formation, the system comprising:

a main gate;

a tailgate connected to the maingate by an active mine face, wherein the active mine face extends at an angle between 95° and 135° relative to the maingate and the active mine face extends between 200 feet and 700 feet from the maingate to the tailgate;

a continuous miner;

a plurality of powered roof supports; and a cable reel assembly operable to store, feed, and receive a cable attached to the continuous miner, wherein the cable reel assembly is mounted on one of the plurality of powered roof supports.

20. The system of claim 19, wherein the angle is between is less than 130°.

21. The system of claim 20, wherein the angle is greater than 100°.

22. The system of claim 19, comprising: at least one flexible conveyor train.

23. The system of claim 22, comprising multiple flexible conveyor trains disposed such that a discharge of a first flexible conveyor train and an inlet of a second flexible conveyor train are located such that the inlet of the second flexible conveyor train receives extracted material discharged from the first flexible conveyor train.

24. The system of claim 23 comprising a guidance system operable to receive a location signal based on relative location of the continuous miner along the face and to send a control signal to the plurality of powered roof supports positioned along the face.

25. The system of claim 19, comprising a power cable extending from the cable reel to the continuous miner.

26. A system for extracting material from subterranean formation, the system comprising:

a main gate;

a tailgate connected to the maingate by an active mine face, wherein the active mine face extends at an angle between 95° and 135° relative to the maingate;

a continuous miner;

a plurality of powered roof supports, a cable reel assembly operable to store, feed, and receive a cable attached to the continuous miner, wherein the cable reel assembly is mounted on one of the plurality of powered roof supports.

27. The system of claim 26, comprising: at least one flexible conveyor train.

28. The system of claim 27, comprising a guidance system operable to receive a location signal based on relative location of the continuous miner along the face and to send a control signal to the plurality of powered roof supports positioned along the face.

29. The system of claim 28, comprising a power cable extending from the cable reel to the continuous miner.

30. The system of claim 26, wherein the angle is between is less than 130°.

31. The system of claim 30, wherein the angle is greater than 100°.

32. The system of claim 26, wherein the active mine face extends between 100 feet and 700 feet from the maingate to the tailgate.

33. The system of claim 32, wherein the active mine face extends more than 200 feet from the maingate to the tailgate.

* * * * *